US009953587B2

(12) United States Patent
Zhang et al.

(10) Patent No.: US 9,953,587 B2
(45) Date of Patent: *Apr. 24, 2018

(54) APPARATUS AND METHOD FOR CONTROLLING LIQUID CRYSTAL DISPLAY BRIGHTNESS, AND LIQUID CRYSTAL DISPLAY DEVICE

(71) Applicant: HISENSE ELECTRIC CO., LTD., Qingdao (CN)

(72) Inventors: Yuxin Zhang, Qingdao (CN); Shunming Huang, Qingdao (CN); Zhicheng Song, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 147 days.

This patent is subject to a terminal disclaimer.

(21) Appl. No.: 15/185,537

(22) Filed: Jun. 17, 2016

(65) Prior Publication Data

US 2017/0061901 A1 Mar. 2, 2017

(30) Foreign Application Priority Data

Sep. 1, 2015 (CN) ..... 2015 1 0550060

(51) Int. Cl.
*G09G 3/34* (2006.01)
*G09G 3/36* (2006.01)

(52) U.S. Cl.
CPC ..... *G09G 3/3426* (2013.01); *G09G 3/3648* (2013.01); *G09G 2320/0238* (2013.01);
(Continued)

(58) Field of Classification Search
CPC ..... G09G 3/3406; G09G 3/2018; G09G 3/36; G09G 3/3426; G09G 5/005; G09G 5/10
See application file for complete search history.

(56) References Cited

U.S. PATENT DOCUMENTS

2004/0257329 A1 12/2004 Park et al.
2005/0057487 A1 3/2005 Takata et al.
(Continued)

FOREIGN PATENT DOCUMENTS

CN 101236728 8/2008
CN 101271208 9/2008
(Continued)

OTHER PUBLICATIONS

Office Action from corresponding Chinese Application No. 201510550065.8 dated Mar. 20, 2017 (13 pages).
(Continued)

*Primary Examiner* — Sepehr Azari
(74) *Attorney, Agent, or Firm* — Harness, Dickey & Pierce, P.L.C.

(57) ABSTRACT

An apparatus for controlling liquid crystal display brightness includes: a subarea image grayscale determining section configured to determine image grayscale values of subarea image data blocks corresponding to backlight subareas according to a received image signal; a subarea backlight value pre-obtaining section configured to pre-obtain subarea backlight values corresponding to the subarea image data blocks according to the image grayscale values of the subarea image data blocks; a subarea backlight value gain section configured to multiply the pre-obtained subarea backlight values with a preset backlight value gain coefficient to obtain gained backlight values of the backlight subareas, wherein the preset backlight value gain coefficient is more than 1; and a subarea backlight value outputting section configured to output the respective gained subarea
(Continued)

backlight values to driver circuits of backlight sources in the corresponding backlight subareas to control the brightness of the backlight sources in the corresponding backlight subareas as a result of driving.

16 Claims, 14 Drawing Sheets

(52) U.S. Cl.
CPC ..... *G09G 2320/0285* (2013.01); *G09G 2320/064* (2013.01); *G09G 2320/066* (2013.01); *G09G 2320/0646* (2013.01); *G09G 2330/021* (2013.01); *G09G 2360/16* (2013.01)

(56) References Cited

U.S. PATENT DOCUMENTS

| | | | | |
|---|---|---|---|---|
| 2005/0179639 | A1 | 8/2005 | Hsieh | |
| 2007/0001997 | A1 | 1/2007 | Kim et al. | |
| 2007/0216636 | A1 | 9/2007 | Lo | |
| 2007/0222730 | A1 | 9/2007 | Kao et al. | |
| 2008/0180383 | A1 | 7/2008 | Lin | |
| 2008/0186393 | A1 | 8/2008 | Lee et al. | |
| 2008/0245949 | A1 | 10/2008 | Morimoto et al. | |
| 2008/0284719 | A1 | 11/2008 | Yoshida | |
| 2009/0128583 | A1 | 5/2009 | Choi | |
| 2009/0167670 | A1 | 7/2009 | Peng et al. | |
| 2009/0189842 | A1 | 7/2009 | Huang et al. | |
| 2010/0020005 | A1 | 1/2010 | Jung et al. | |
| 2010/0103089 | A1 | 4/2010 | Yoshida et al. | |
| 2010/0164922 | A1 | 7/2010 | Nose et al. | |
| 2010/0245397 | A1 | 9/2010 | Choe et al. | |
| 2011/0051161 | A1* | 3/2011 | Yen | G06T 5/009 358/1.9 |
| 2011/0205442 | A1 | 8/2011 | Mori et al. | |
| 2011/0292018 | A1 | 12/2011 | Kubota et al. | |
| 2012/0249613 | A1 | 10/2012 | Takada et al. | |
| 2013/0265337 | A1 | 10/2013 | Furumoto et al. | |
| 2015/0009249 | A1* | 1/2015 | Kudo | G09G 3/36 345/691 |
| 2015/0213781 | A1* | 7/2015 | Huang | G09G 5/10 345/207 |
| 2015/0364111 | A1* | 12/2015 | Zhang | G09G 5/10 345/690 |
| 2015/0365621 | A1* | 12/2015 | Zhang | G09G 5/005 348/791 |
| 2016/0284283 | A1 | 9/2016 | Kurita | |

FOREIGN PATENT DOCUMENTS

| | | | |
|---|---|---|---|
| CN | 101329458 | A | 12/2008 |
| CN | 101383139 | | 3/2009 |
| CN | 101650921 | | 2/2010 |
| CN | 101673521 | A | 3/2010 |
| CN | 102081258 | A | 6/2011 |
| CN | 102243855 | A | 11/2011 |
| CN | 102473383 | | 5/2012 |
| CN | 102568386 | A | 7/2012 |
| CN | 102890918 | A | 1/2013 |
| CN | 103050095 | A | 4/2013 |
| CN | 103310765 | | 9/2013 |
| CN | 104050934 | | 9/2014 |
| CN | 104599642 | | 5/2015 |
| DE | 102008004281 | | 8/2008 |
| JP | 2002014660 | | 1/2002 |
| JP | 2008268798 | A | 11/2008 |
| KR | 100809073 | | 3/2008 |
| KR | 1020110066510 | | 6/2011 |
| WO | 2013166994 | | 11/2013 |

OTHER PUBLICATIONS

Office Action from related Chinese Application No. 201510550126.0 dated Mar. 23, 2017 (15 pages).
Office Action from related Chinese Application No. 201510592299.9 dated Oct. 18, 2017 (3 pages).
Office Action from related Chinese Application No. 201510592299.9 dated Apr. 13, 2017 (10 pages).
Office Action from related Chinese Application No. 201510549986.2 dated Mar. 24, 2017 (11 pages).
Office Action from related Chinese Application No. 201510665186.7 dated Mar. 31, 2017 (9 pages).
Office Action from related Chinese Application No. 201510664843.6 dated Feb. 23, 2017 (7 pages).
U.S. Appl. No. 15/185,682, filed Jun. 17, 2016, Yuxin Zhang et al.
U.S. Appl. No. 15/158,759, filed May 19, 2016, Jia Yang et al.
U.S. Appl. No. 15/158,702, filed May 19, 2016, Yuxin Zhang et al.
U.S. Appl. No. 15/173,205, filed Jun. 3, 2016, Yuxin Zhang et al.
U.S. Appl. No. 15/173,667, filed Jun. 5, 2016, Yuxin Zhang et al.
U.S. Appl. No. 15/173,669, filed Jun. 5, 2016, Yuxin Zhang et al.

* cited by examiner

APPARATUS AND METHOD FOR CONTROLLING LIQUID CRYSTAL DISPLAY BRIGHTNESS, AND LIQUID CRYSTAL DISPLAY DEVICE

CROSS-REFERENCE TO RELATED APPLICATION

This application claims the benefit and priority of Chinese Patent Application No. 201510550060.5 filed Sep. 1, 2015. The entire disclosure of the above application is incorporated herein by reference.

FIELD

This disclosure relates to the field of liquid crystal display technologies and particularly to an apparatus and a method for controlling liquid crystal display brightness, and a liquid crystal display device.

BACKGROUND

This section provides background information related to the present disclosure which is not necessarily prior art.

A Liquid Crystal Display (LCD) device typically controls backlight brightness through dynamic backlight modulation to thereby save energy and improve the display contrast and other image quality-of-picture effects. As illustrated in FIG. 1 which is a structural principle diagram of dynamic backlight modulation in the liquid crystal display in the prior art, the liquid crystal display device includes an image processing section configured to receive an input image signal, and to acquire backlight data according to grayscale brightness of the image signal, where on one hand, the image signal is converted in format in accordance with predetermined specifications of a display panel, and output to a timing controller (TCON) in a liquid crystal display section, and a timing control signal and a data signal are generated by the timing controller to drive the liquid crystal panel; and on the other hand, the acquired backlight data are output to a backlight processing section, and the backlight data are converted by the backlight processing section into a backlight control signal to control a backlight driver section to control brightness of backlight sources in a backlight assembly so that if the brightness of the image is high, then the backlight source will be driven for high backlight brightness, and if the brightness of the image is low, then the backlight source will be driven for low backlight brightness.

SUMMARY

This section provides a general summary of the disclosure, and is not a comprehensive disclosure of its full scope or all of its features.

This disclosure provides a method and apparatus for controlling liquid crystal display brightness, and a liquid crystal display device so as to address the problem of a limited improvement to the picture contrast in the prior art.

In an aspect, an embodiment of this disclosure provides a method for controlling liquid crystal display brightness, the method including:

determining, by an apparatus for controlling liquid crystal display brightness, image grayscale values of subarea image data blocks corresponding to backlight subareas according to a received image signal, and pre-obtaining subarea backlight values corresponding to the subarea image data blocks according to the image grayscale values of the subarea image data blocks;

multiplying, by the apparatus for controlling liquid crystal display brightness, the pre-obtained subarea backlight values with a preset backlight value gain coefficient to obtain gained backlight values of the backlight subareas, wherein the preset backlight value gain coefficient is more than 1; and outputting, by the apparatus for controlling liquid crystal display brightness, the respective gained subarea backlight values to driver circuits of backlight sources in the corresponding backlight subareas to control the brightness of the backlight sources in the corresponding backlight subareas as a result of driving.

In another aspect, an embodiment of this disclosure provides an apparatus for controlling liquid crystal display brightness, the apparatus including:

a subarea image grayscale determining section configured to determine image grayscale values of subarea image data blocks corresponding to backlight subareas according to a received image signal;

a subarea backlight value pre-obtaining section configured to pre-obtain subarea backlight values corresponding to the subarea image data blocks according to the image grayscale values of the subarea image data blocks;

a subarea backlight value gain section configured to multiply the pre-obtained subarea backlight values with a preset backlight value gain coefficient to obtain gained backlight values of the backlight subareas, wherein the preset backlight value gain coefficient is more than 1; and a subarea backlight value outputting section configured to output the respective gained subarea backlight values to driver circuits of backlight sources in the corresponding backlight subareas to control the brightness of the backlight sources in the corresponding backlight subareas as a result of driving.

In a further aspect, an embodiment of this disclosure provides a liquid crystal display device including:

a memory configured to store programs and various preset lookup table data;

an apparatus for controlling liquid crystal display brightness configured to execute the programs in the memory, and to invoke the various lookup table data according to the executed programs; to receive an image signal, to process the data, and to output the image data to a timing controller so that the timing controller generates a driver signal according to the image data to control a liquid crystal panel to display the image; and to output subarea backlight values to a backlight processing unit according to the image signal;

the backlight processing unit configured to determine duty ratios of corresponding PWM signals according to the respective subarea backlight values, and to output the duty ratios to a PWM driver unit; and the PWM driver unit configured to generate PWM control signals to control backlight sources in corresponding subareas;

wherein the apparatus for controlling liquid crystal display brightness includes:

a subarea image grayscale determining section configured to determine image grayscale values of subarea image data blocks corresponding to backlight subareas according to a received image signal;

a subarea backlight value pre-obtaining section configured to pre-obtain subarea backlight values corresponding to the subarea image data blocks according to the image grayscale values of the subarea image data blocks;

a subarea backlight value gain section configured to multiply the pre-obtained subarea backlight values with a preset backlight value gain coefficient to obtain gained backlight values of the backlight subareas, wherein the preset backlight value gain coefficient is more than 1; and a subarea backlight value outputting section configured to output the respective gained subarea backlight values to driver circuits of backlight sources in the corresponding backlight subareas to control the brightness of the backlight sources in the corresponding backlight subareas as a result of driving.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Dynamic backlight modulation generally includes subarea backlight modulation and global backlight modulation, where in the global backlight modulation, the backlight brightness is controlled by acquiring the average brightness over one frame of image so that the real backlight brightness is determined by the average grayscale value across the frame of global image, so the resulting backlight brightness will be maximized as a result of driving if the average grayscale value of the image is maximized (i.e., the all-white image), and in order to guarantee the reliability of the backlight source in operation, the maximized backlight brightness is typically controlled below rated brightness of the backlight source in operation. Typically in a normally displayed picture, the average grayscale brightness across the entire dynamic video picture can be statistically known at around 50% IRE, so that the average value of the backlight brightness may be around 50% of the maximized backlight brightness. Thus the real average power of the backlight source operating with global backlight modulation is controlled around half of the rated power, and there is some apparent effect of saving energy. However in global backlight modulation, the average grayscale brightness across one or more consecutive frames of global image is acquired, and global backlight source brightness is controlled by the average grayscale brightness of the image(s), but the average grayscale brightness of the image(s) may not reflect brightness details between local pictures of the images, and a variation in contrast of the image(s) may be more reflected in the difference in brightness between the local pictures of the images, and thus may not significantly improve the quality-of-picture effect for the display contrast.

Figure 1:
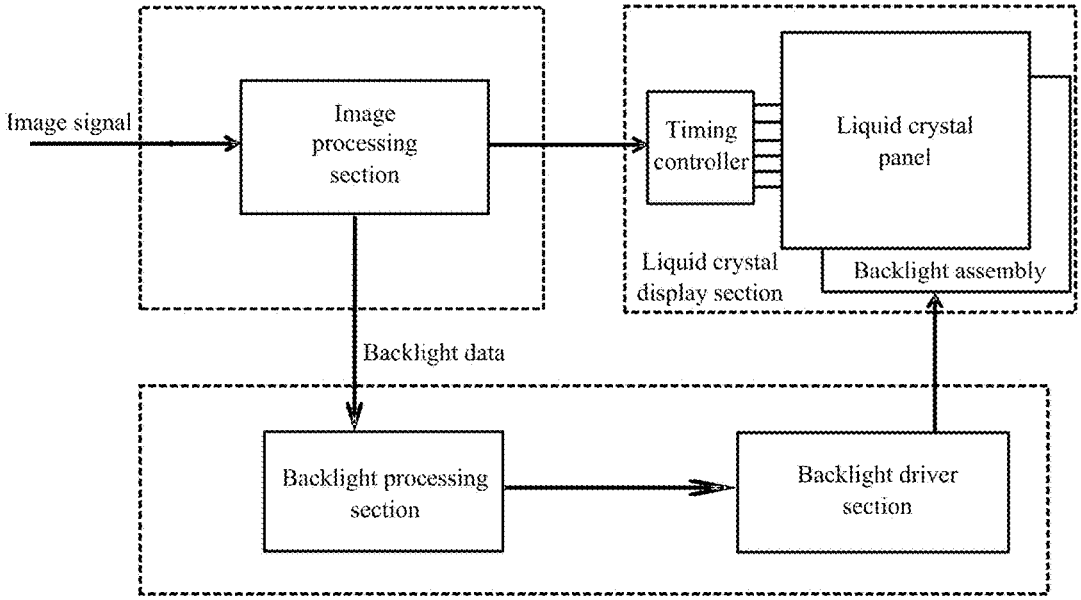
FIG. 1 is a structural principle diagram of dynamic backlight modulation in the liquid crystal display in the prior art.
Figure 2:
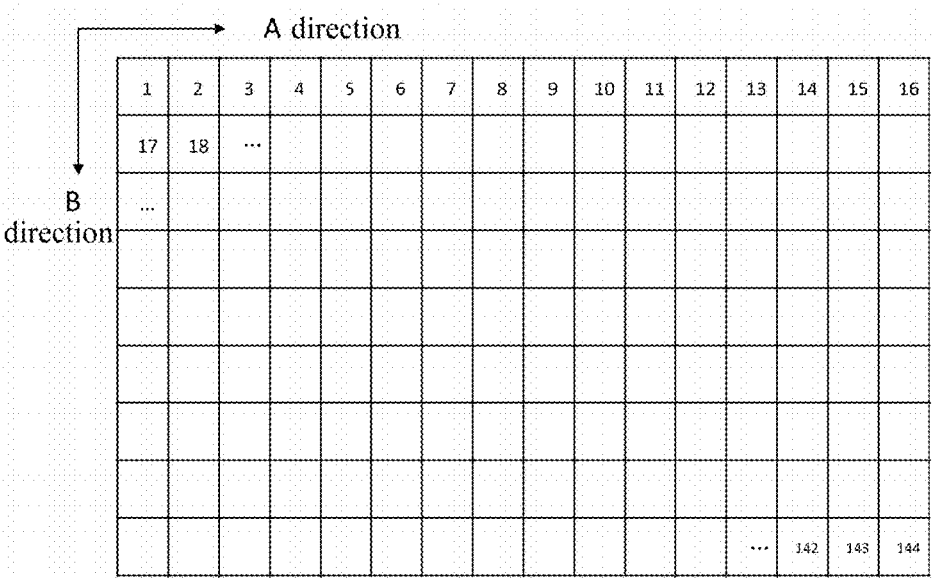
FIG. 2 is a schematic diagram of backlight subareas in subarea dynamic backlight modulation in the prior art.

Subarea dynamic backlight modulation will be described as follows. As illustrated in FIG. 2 which is a schematic diagram of backlight subareas in subarea dynamic backlight modulation in the prior art, the entire matrix of backlight sources includes M subareas in the direction A and N subareas in the direction B, and as illustrated, if M=16 and N=9, then there will be M*N=144 backlight subareas in total, in each of backlight subareas the backlight source brightness can be controlled separately as a result of driving, where it shall be noted that ideally the respective backlight subareas can illuminate their backlight areas separately, but in fact, the brightness of the adjacent backlight sources may be affected somewhat. In subarea dynamic backlight modulation, each frame of global image is segmented into a plurality of subarea image data blocks corresponding to the backlight subareas, and grayscale data in the respective subarea image data blocks are acquired to obtain the backlight data of the corresponding backlight subareas, and the obtained backlight data of the respective subareas reflect the differences in brightness between the corresponding subarea image data blocks, so that the backlight brightness of the backlight subareas may be determined by the brightness of the image data blocks corresponding to the backlight subareas, and the variations in backlight brightness of the subareas may reflect the grayscale brightness of the subarea image data blocks in which area pictures need to be displayed, and highlight the differences in display brightness between the local pictures of the displayed image, thus improving the contrast quality-of-picture effect of the dynamic image.

In order to improve the effect of a dynamic contrast quality-of-picture of a displayed image in a liquid crystal display device, subarea dynamic backlight modulation is applied so that the entire matrix of backlight sources thereof is divided into a plurality of backlight subareas in row and column directions, and the backlight sources in each of the backlight subareas can be driven separately to control brightness thereof, where it shall be noted that ideally the respective backlight subareas can illuminate their backlight areas separately, but in fact, the brightness of the adjacent backlight sources may be affected somewhat. Image grayscale brightness of subarea image data blocks displayed on a liquid crystal display panel corresponding to the backlight subareas is acquired, backlight values of the backlight subareas are obtained according to the image grayscale brightness in an algorithm of obtaining the backlight values, and the backlight sources in the subareas are driven by the backlight values to emit light so as to provide desirable backlight brightness for the image in the subareas to be displayed. It shall be noted that a subarea image data block refers to a subset of image data of all pixels displayed in a display subarea of the liquid crystal display panel at the same position as the backlight subarea, where the liquid crystal display panel is divided uniformly into subareas under the same dividing rule as backlight subareas, however the backlight subareas may not overlap completely with the boundaries of the areas displayed on the liquid crystal panel corresponding to the subarea image data blocks due to a design error and a process error, or taking into account a design demand and other factors, and it shall be further noted that the backlight subareas, and the subareas of the liquid crystal panel relate to virtual boundaries instead of physical boundaries in a real design.

Figure 3:
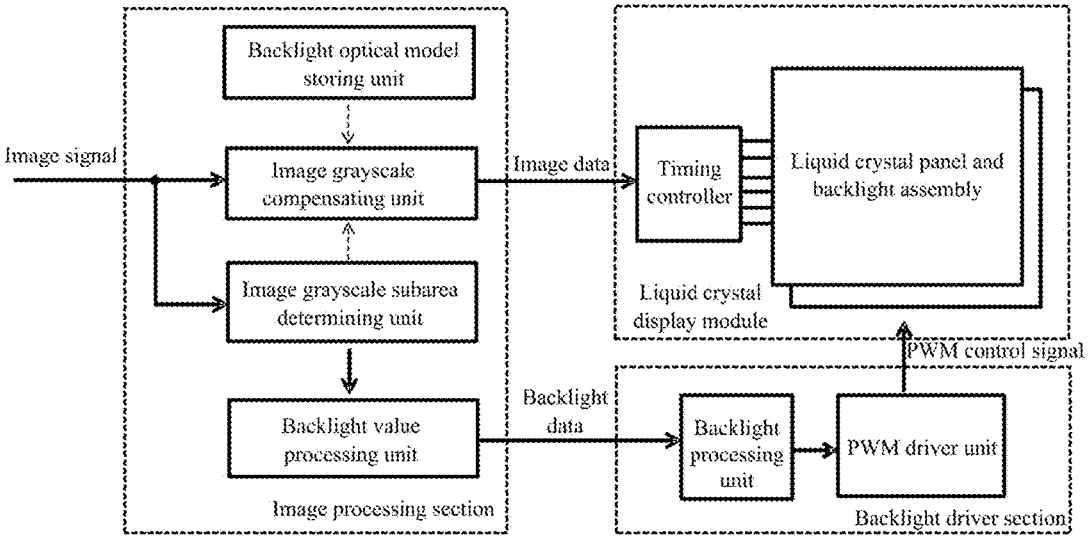
FIG. 3 is a structural diagram of obtaining the backlight value of the subarea in subarea dynamic backlight modulation in the prior art.

As illustrated in FIG. 3, the backlight values of the backlight data of the image are acquired in subarea dynamic backlight modulation in the prior art as follows: an image processing section receives an input image signal, and on one hand, an image grayscale subarea determining unit is configured to determine a brightness grayscale of each image pixel in a subarea image data block in the image signal, and a backlight value processing unit is configured to obtain a backlight value of the subarea from a determination result, where the backlight value can be obtained particularly as the maximum value, the average value, the average value of weighted values, the weighted value of average values, etc.; and on the other hand, in order to compensate for a difference in display brightness of the image arising from different backlight brightness in the different backlight subareas, an image grayscale compensating unit can further perform a predetermined image data grayscale compensation algorithm on the input image signal based on backlight value in each backlight subarea according to a preset function relationship in a backlight optical model storing unit, and obtain and output compensated image data to a timing controller to drive the liquid crystal panel to display the image. Particularly in the algorithm above for obtaining the backlight value, for example, if the image grayscale of each image pixel ranges from 0 to 255 (taking a 8-bit display screen as an example), then the backlight value of the subarea may be obtained as any one value from 0 to 255; and then a backlight processing unit receives and then converts directly the any one backlight value from 0 to 255 into a PWM backlight drive signal to drive the backlight source in the subarea, where the backlight source is driven by the maximum backlight value of 255 accordingly for the maximum backlight brightness, and the backlight source is driven by any other backlight value between 0 and 255 for lower peak brightness than the maximum backlight brightness. As can be known from an analysis thereof, the index of picture contrast is determined by the ratio of the maximum peak brightness to the minimum display brightness, i.e., the ratio of display brightness of a picture with the display grayscale value of 255 to display brightness of a picture with the display grayscale value of 0, but the brightness of the picture with the display grayscale value of 0 is typically predetermined and hardly influenced by the backlight brightness, so the maximum peak brightness is a predominating factor of the index of displayed picture contrast. As can be known from the analysis above, since the backlight peak brightness of each subarea is limited to the maximum backlight value of 255, if the maximum peak brightness of the respective subareas is limited to the maximum backlight value of 255, then an improvement to the contrast of the displayed picture may be discouraged.

In order to address the drawback in the algorithm of obtaining the backlight value in the prior art, and to further improve the effect of the contrast quality-of-picture of the image displayed on the liquid crystal display device adopting subarea dynamic backlight controlling, this disclosure proposes a method and apparatus for controlling liquid crystal display brightness, and a liquid crystal display device.

All the embodiments of this disclosure relate to an 8-bit (28=256 grayscales) liquid crystal display screen by way of an example.

Figure 4:
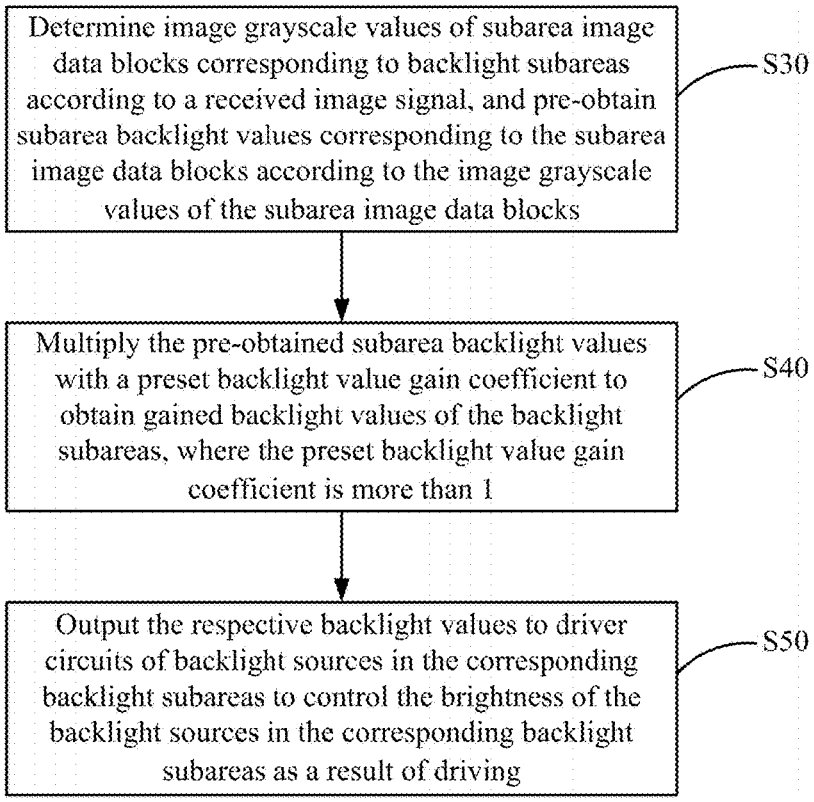
FIG. 4 is a schematic flow chart of a method for controlling liquid crystal display brightness according to an embodiment of this disclosure.

FIG. 4 is a schematic flow chart of a method for controlling liquid crystal display brightness according to an embodiment of this disclosure. As illustrated in FIG. 4, an executor of this embedment can be an image processing device in which processing and storing functions are integrated. The image processing device can be a single video processing chip, or consisted of a plurality of video processing chips cooperating with each other, and can be arranged in a liquid crystal display device adopting subarea dynamic backlight controlling technology, where the liquid crystal display device can be a liquid crystal TV set, a liquid crystal display, a tablet computer, etc.; and this method discloses how to generate backlight values for driving brightness of backlight sources in respective backlight subareas according to an input image signal to improve the effect of display contrast of an image as a whole, and the method for controlling liquid crystal display brightness includes:

The step S30 is to determine image grayscale values of subarea image data blocks corresponding to backlight subareas according to a received image signal, and to pre-obtain subarea backlight values corresponding to the subarea image data blocks according to the image grayscale values of the subarea image data blocks.

In this embodiment, the image grayscale values are determined in accordance with a preset rule, and the preset rule can be a pre-stored function model in which a liquid crystal panel is divided into a plurality of virtual subareas at the same proportion as the backlight subareas, and image data of all the pixels displayed in one of the virtual subareas are aggregated into a subarea image data block.

Particularly the subarea backlight value corresponding to each subarea image data block is pre-obtained from the grayscale values of the respective pixels in the subarea in a predetermined algorithm, where the pre-obtained subarea backlight value is not finally used to drive the backlight sources, but a gain may be further applied to the pre-obtained subarea backlight value and/or the pre-obtained subarea backlight value may be adjusted, to obtain a final backlight value.

It shall be noted that the predetermined algorithm can be an algorithm of averaging the grayscales of all the pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort, and the backlight data of the subareas can be obtained in alternative algorithms in this embodiment and other embodiments, so the embodiments of the disclosure will not be limited thereto.

By way of an example, the matrix of backlight sources in the liquid crystal display panel is divided into 16 subareas in the row direction and 9 subareas in the column direction, so that the entire matrix of backlight sources are divided into 144 backlight subareas, in each of which the backlight sources can be driven separately to control brightness, where the brightness can be controlled through current or PWM-controlling, and the backlight sources can be LED backlight sources. The resolution of the liquid crystal display panel in the liquid crystal display device is 3840*2160, and accordingly there are 16*9 virtual subareas on the liquid crystal display panel under the backlight subarea dividing rule. As per the positions of the virtual subareas on the liquid crystal display panel where the image data are displayed, the image data are segmented into 16*9 subarea image data blocks in accordance with the preset function model, where each subarea image data block includes 240*240 pixels, so the 240*240 pixels in each subarea image data block are displayed on one virtual subarea of the display panel at display brightness controlled by the backlight sources in the corresponding backlight subarea. Then grayscale values of the 240*240 pixels in the one subarea image data block are determined, the average of the grayscale values of the subarea image data block is obtained as 160 in the predetermined backlight algorithm, and the pre-obtained subarea backlight value of the corresponding backlight subarea is obtained as 160; and the pre-obtained subarea backlight values of the other backlight subareas are obtained similarly.

It shall be noted that the backlight subarea may not overlap completely with the boundary of the area displayed on the liquid crystal panel corresponding to the subarea image data block due to a design error and a process error, or taking into account a design demand and other factors, that is, the real number of pixels in the subarea image data block may be more than 240*240, so that there may be pixels overlapping between the adjacent subarea image data blocks.

The step S40 is to multiply the pre-obtained subarea backlight values with a preset backlight value gain coefficient to obtain gained subarea backlight values of the backlight subareas, where the preset backlight value gain coefficient is more than 1.

In this embodiment, the subarea backlight values of all the backlight subareas are pre-obtained respectively as described in the step S30 where the subarea backlight values are pre-obtained, and then the subarea backlight values are multiplied respectively with the preset backlight value gain coefficient to obtain the gained backlight values of the respective backlight subareas. Since the preset backlight value gain coefficient is more than 1, the gained backlight values of the respective backlight subareas as a result of the multiplication are more than the pre-obtained subarea backlight values, so that subarea peak brightness can be improved by driving the backlight of the subareas using the gained backlight values, and as can be apparent from the analysis above, the improvement of subarea peak brightness can enhance the contrast of displayed pictures of the image.

It shall be noted that those skilled in the art can select the particular value of the preset backlight value gain coefficient as needed for the design, for example, if the backlight value gain coefficient is taken as 1.5, then each subarea backlight value may be pre-obtained and multiplied respectively with the backlight value gain coefficient of 1.5, or if the backlight value gain coefficient is taken as 2, then each subarea backlight value may be pre-obtained and multiplied respectively with the backlight value gain coefficient of 2. In order to ensure the reliability of the backlight sources being lightened, it may not be appropriate for the amplitude of the gain to be too large, and the parameter can be selected by those skilled in the art without any inventive effort.

By way of an example, as in the step S30, a subarea backlight value is pre-obtained as 160 in a backlight subarea, and multiplied with the backlight value gain coefficient of 2 to obtain the gained backlight value of the subarea as 320, so that the gained backlight value can be improved significantly, and the peak brightness of the backlight subarea can be improved significantly by driving the backlight sources of the backlight subarea using the gained backlight value, thus enhancing the effect of the contrast quality of picture.

In this embodiment, the preset backlight value gain coefficient can be some defined value more than 1 for all the image frames, so that the backlight value gain coefficient may be the same for the backlight value of each subarea in a picture of a frame of image, and also the same for different frames of images, so the same backlight value gain coefficient may apply to all the backlight subareas in all the frames of images.

Figure 6:
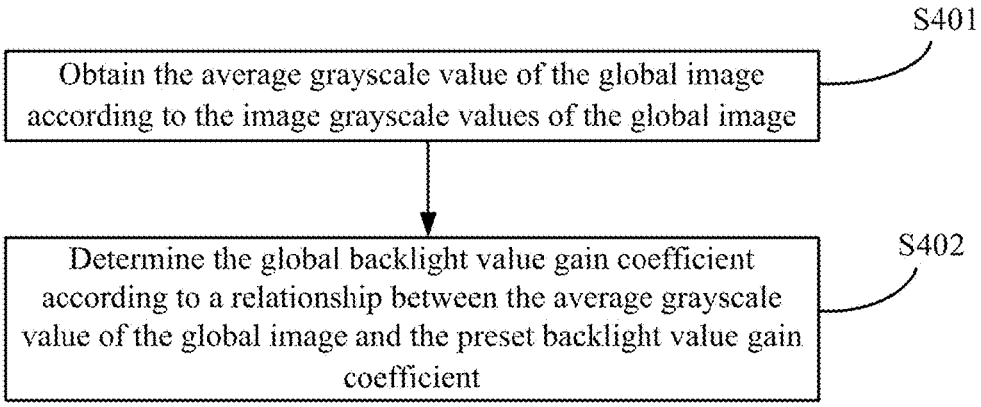
FIG. 6 is a schematic flow chart of obtaining a backlight value gain coefficient according to an embodiment of this disclosure.

Furthermore in another embodiment of this disclosure, the preset backlight value gain coefficient can be obtained particularly by presetting a lookup table. As illustrated in FIG. 6 which is a schematic flow chart of obtaining a backlight value gain coefficient according to a first embodiment of this disclosure, the flow particularly includes:

The step S401 is to obtain the average grayscale value of the global image according to the grayscale values of the global image.

Figure 5:
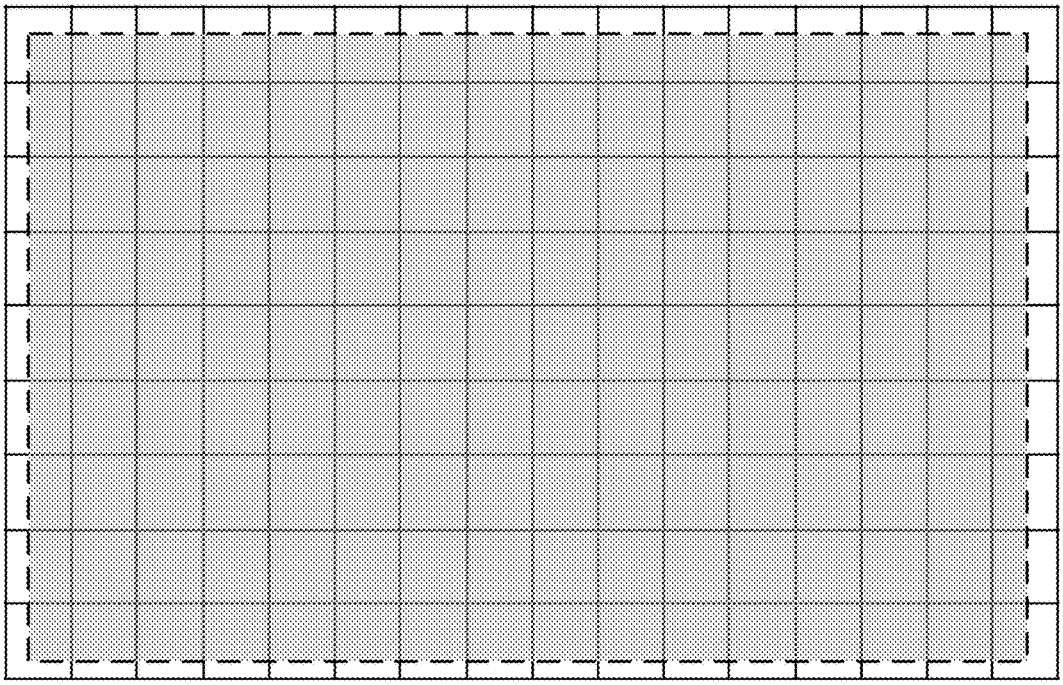
FIG. 5 is a schematic diagram of segmented image data blocks in a display area according to an embodiment of this disclosure.

By way of an example, as illustrated in FIG. 5, which is a schematic diagram of segmented image data blocks in a display area according to the first embodiment of this disclosure, together with FIG. 2, alike the display panel is divided into 144 virtual subareas under the same dividing rule as backlight subareas, the global image displayed at the corresponding position on the display panel is segmented into 144 subarea image data blocks, the grayscale values of all the pixels in each subarea image data block are obtained respectively, and then the average of the grayscale values of the global image is obtained in the preset algorithm, where the preset algorithm can be an algorithm of averaging the grayscales of all the pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort, and the backlight data of the subareas can be obtained in alternative algorithms in this embodiment and other embodiments, so the embodiments of this disclosure will not be limited thereto.

It shall be noted that particularly in the step S401, the average of the grayscale average values of all the subarea image data blocks is calculated from the grayscale average values of the respective subarea image data blocks obtained in the step S30 to obtain the average grayscale value of the global image; or firstly the grayscale values of all the pixel in the global image can be obtained, and then the average grayscale value of the global image can be obtained from the grayscale values of all the pixels in the preset algorithm.

The step S402 is to determine the backlight value gain coefficient according to a relationship between the average grayscale value of the global image and the preset backlight value gain coefficient.

Particularly a backlight value gain coefficient lookup table needs to be pre-stored, in which the correspondence relationship between the average grayscale value of the global image and the preset backlight value gain coefficient is recorded, where the gain coefficient is obtained from the average grayscale value of the image; and there are 256 grayscale values in total from 0 to 255 on the transverse axis, and each grayscale value corresponds respectively to a backlight value gain coefficient. The lookup table is searched for the backlight value gain coefficient corresponding to the average grayscale value of the global image using the average grayscale value of the image.

Figure 7:
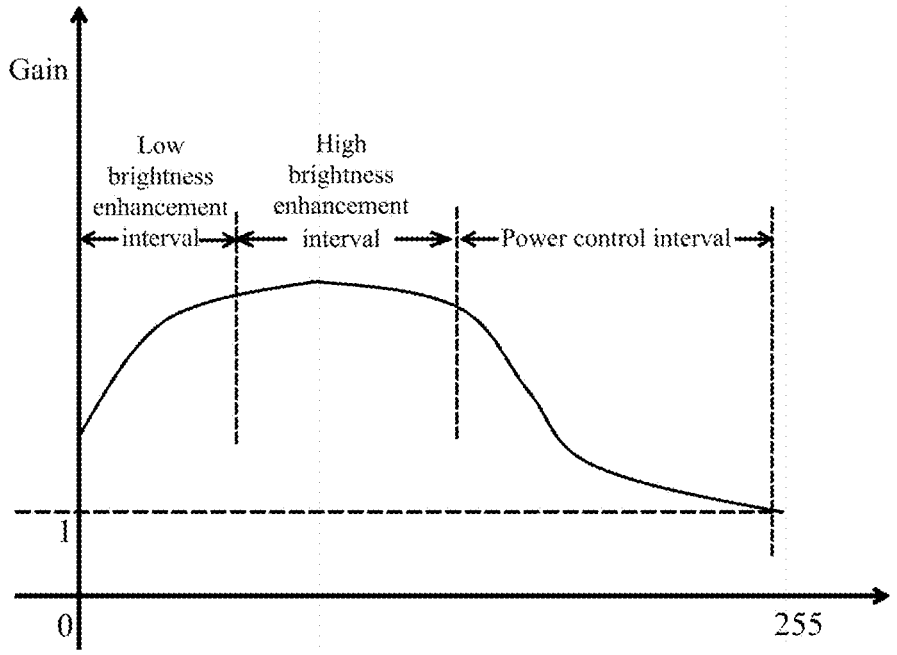
FIG. 7 is a schematic diagram of a backlight value gain curve according to an embodiment of this disclosure.

By way of an example, as illustrated in FIG. 7 which is a schematic diagram of a backlight value gain curve according to the first embodiment of this disclosure, the gain curve can be particularly divided into a low brightness enhancement interval, a high brightness enhancement interval and a power control interval along with the increasing average grayscale value of the image, where the gain coefficient in the high brightness enhancement interval is more than the gain coefficient in the low brightness enhancement interval and the gain coefficient in the power control interval respectively. If the grayscale value of the global image is low, e.g., the average grayscale value falls into the range of 0 to 100, then it may lie in the low brightness enhancement interval, and the gain coefficient may increase with the increasing brightness of the global image, where if the brightness of the global image is low, then the gain coefficient may approach 1, and the amplitude of the backlight value gain may be low; and as the brightness of the global image is increasing, the gain coefficient may be increasing, and the amplitude of the backlight value gain may also be increasing. If the grayscale value of the global image is further increasing, for example, the average grayscale value falls into the range of 100 to 200, then it may lie in the high brightness gain interval; and since the high brightness gain interval corresponds to an intermediate brightness of the grayscale of the image, there may be a lot of hierarchal details of the image, and the amplitude of the gain may be large, thus highlighting the sense of hierarchy in the pictures, where the maximum value of the gain coefficient lies in the high brightness gain interval, and particularly the particular parameters for the position of the maximum value of the gain coefficient on the curve, and the particular data thereof can be selected by those skilled in the art without any inventive effort. If the brightness of the global image is very high, for example, the average grayscale value falls into the range of 200 to 255, then since the overall brightness of the image is high, the brightness of the image is substantially saturated, the details of the image become less, and the brightness of the entire pictures in the backlight area is sufficiently high, so that human eyes become less sensitive to the high brightness of the image in this area, and thus it may be substantially unnecessary to further enhance the brightness of backlight, and on the contrary, power consumption need to be controlled by lowering the amplitude of the backlight gain. Accordingly the gain coefficient may become less while the average grayscale value of the global image is further increasing.

It shall be noted that in this embodiment, the backlight value gain coefficient corresponds to the average grayscale value of the global image in each frame of image in a one-to-one manner, and the average grayscale value of a frame of global image is uniquely determined in the predetermined algorithm, where the determined average grayscale value corresponds to a determined backlight value gain coefficient. While a frame of pictures is being displayed, all the backlight values of the respective backlight subareas are multiplied with the same backlight value gain coefficient. However for typically sequentially displayed moving pictures, different average grayscale values may be obtained for different frames of images, so the different frames of image may correspond to different backlight value gain coefficients. As can be apparent from the analysis above, the different backlight value gain coefficients may result in different gain amplitudes of backlight brightness, that is, different gain amplitudes of backlight may be generated based on different images to thereby improve the dynamic contrast of the displayed pictures and control the power consumption of the backlight sources.

The step S50 is to output the respective subarea backlight values to driver circuits of the backlight sources in the corresponding backlight subareas to control the brightness of the backlight sources in the corresponding backlight subareas as a result of driving.

Figure 9:
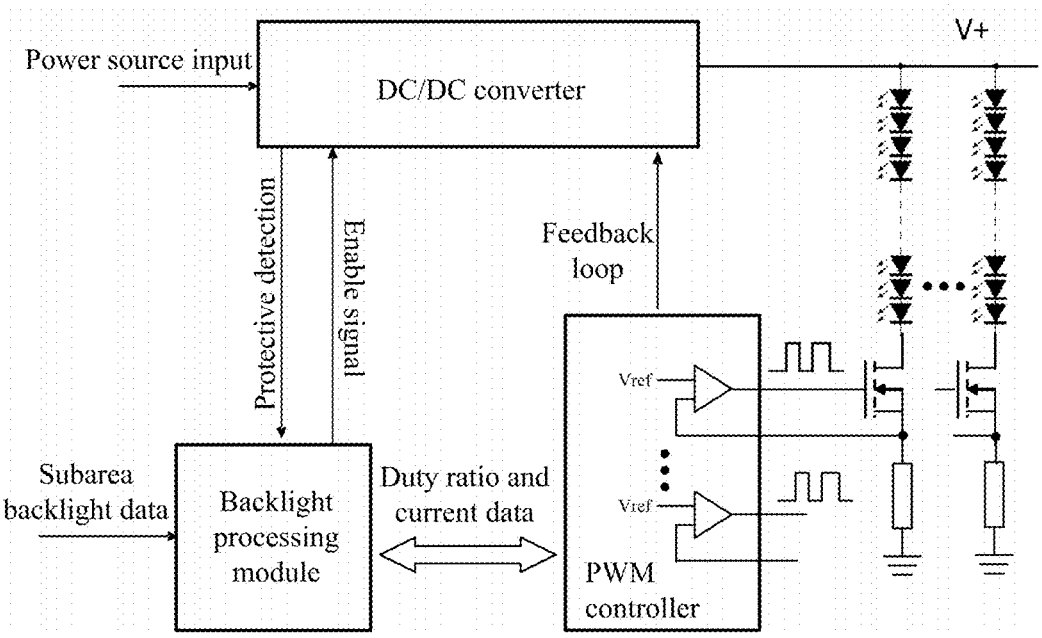
FIG. 9 is a structural diagram of a backlight source driver according to an embodiment of this disclosure.

In some embodiments of this disclosure, as illustrated in FIG. 9 which is a structural diagram of the backlight source driver in the first embodiment of this disclosure, the backlight processing module outputs the respective gained subarea backlight values to the driver circuits of the backlight sources in the respective subareas, and determines duty ratios of corresponding PWM signals according to the backlight data of the respective subareas, where if the backlight data are a brightness value ranging from 0 to 255, then the duty ratio of the PWM signal may become larger as the brightness value is increasing, and the backlight processing module sends the determined duty ratios of the PWM signals to PWM controllers corresponding to the real backlight elements, and the PWM controllers output control signals according to the duty ratios to the real backlight elements to control MOS transistors connected with strings of LED lamps to be switched on or off so as to control the real backlight elements to generate brightness corresponding to the backlight data. When the PWM controllers control the real backlight elements according to the PWM duty ratios to generate the brightness corresponding to the backlight data, the amplitudes of the PWM signals can be a preset value, that is, the real output current is preset.

In other embodiments of this disclosure, the backlight processing module can further send current data in advance to the PWM controllers, and the PWM controllers can adjust the real output current according to the current data and preset reference voltage Vref to thereby control the real backlight elements to generate the brightness corresponding to the backlight data, where there is higher backlight brightness corresponding to larger output current given a same duty ratio. The real output current Iout=(current data/Imax) *(Vref/Rs), where Vref represents the preset reference voltage, e.g., 500 mV, and Rs represents the resistance of a current sampling resistor below an MOS transistor, e.g., 1Ω. The current data are typically set by operating registers in the PWM controller, and if the bit width of the register is 10 bit, then Imax=1024 in the equation above, so the current data can be calculated as a function of Tout required in reality. For example, if current of 250 mA is required, then the current data may be set 512 in the equation above. The PWM controllers typically include a plurality of cascaded chips, each of which can drive a plurality of PWM signals to be output to the strings of LED lamps.

It shall be noted that as illustrated in FIG. 9, a DC/DC converter is configured to convert voltage output by a power source into voltage required for strings of LED lamps, and to maintain the stable voltage through a feedback from a feedback circuit.

Figure 8:
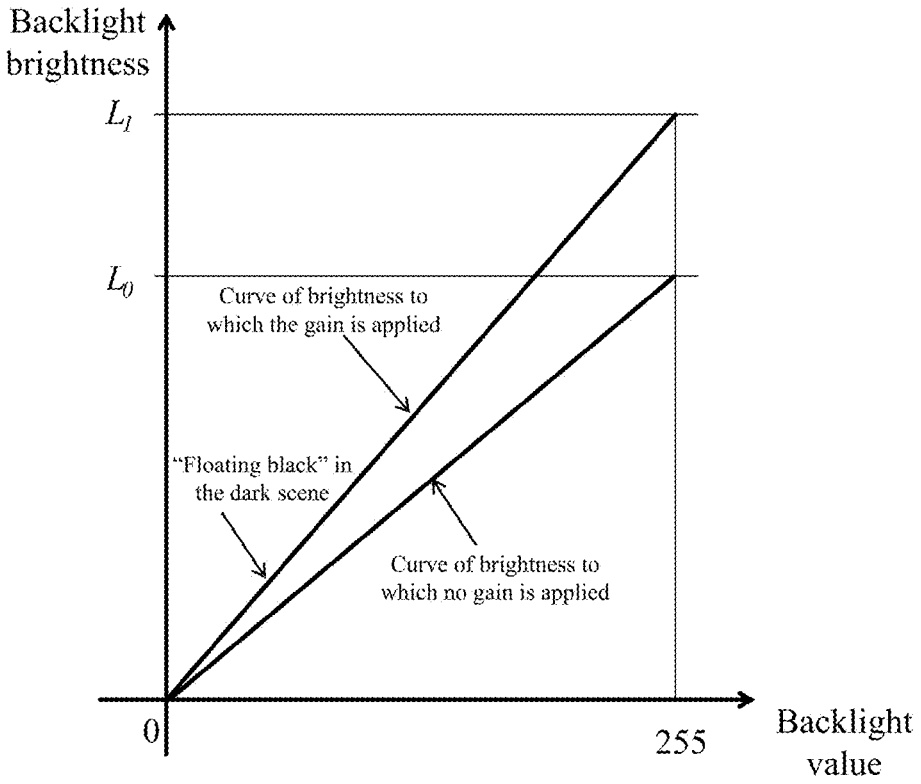
FIG. 8 is a schematic diagram of comparison of backlight brightness under backlight values before and after a gain is applied according to an embodiment of this disclosure.

In the some embodiments of this disclosure, on one hand, the pre-obtained subarea backlight values are calculated from the grayscale values of the subarea image data blocks, and then the average grayscale value of the global image is further obtained, the display brightness of the image is recorded for the average grayscale value of the global image, the corresponding backlight value gain coefficient is determined, and the respective pre-obtained subarea backlight values are multiplied respectively with the same backlight value gain coefficient to obtain the gained subarea backlight values which are output to the backlight driver circuit to drive the backlight sources in the respective backlight subareas, thus improving the backlight peak brightness, and further enhancing the dynamic contrast of the displayed image. As illustrated in FIG. 8 which is a schematic diagram of comparison of backlight brightness under the backlight values before and after the gain is applied according to the first embodiment of this disclosure, the comparison between the unchanged and changed backlight brightness can show that the maximum peak brightness of backlight in the brightness curve to which no gain is applied is L0, and the maximum peak brightness of backlight in the brightness curve to which the gain is applied is L1, so there is a significant improvement of the backlight brightness in the brightness curve to which the gain is applied, over the brightness curve to which no gain is applied.

On the other hand, as can be apparent from the analysis above, further to the improvement of the backlight peak brightness to which the gain is applied, with respect to the backlight peak brightness to which no gain is applied, the backlight values in all the backlight subareas are multiplied with the same gain coefficient for backlight scanning of a frame of a picture being displayed, so that the backlight brightness corresponding to a brighter local area in the picture of the image can be enhanced, but also the backlight brightness corresponding to a darker local area in the picture of the image can be enhanced at the same proportion, for example, the backlight brightness in a darker area of a black picture can become higher as a whole, so that if the dark area of the picture is improved in backlight brightness, then the part of the image at lower brightness may come with the phenomenon of "black floating" (floating black). In other words, the display brightness corresponding to a black image with the grayscale value of 0 is typically controlled around 0.1 to 0.3 nit, i.e., reference black, so that if the backlight brightness in the black picture is improved at the same proportion, then the display brightness of the reference black may be far higher than 0.1 to 0.3 nit, that is, the picture in the reference black may be distorted in brightness. Since human eyes are sensitive to the appearing black picture, the distribution in brightness of the black picture may be a factor influencing the effect of the contrast quality of picture.

Figure 20:
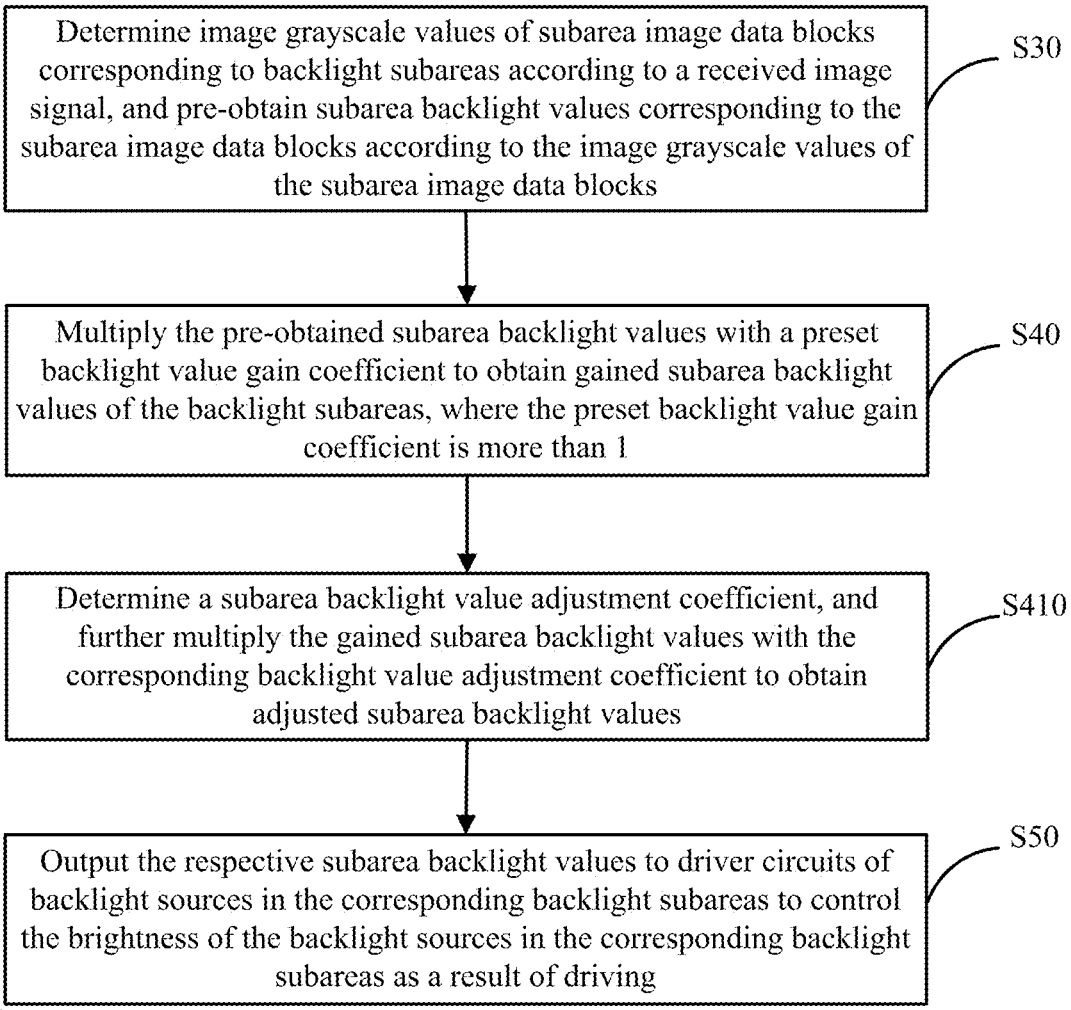
FIG. 20 is a schematic flow chart of another method for controlling liquid crystal display brightness according to an embodiment of this disclosure.

Furthermore a second embodiment of this disclosure further provides a method for controlling liquid crystal display brightness, where the enhancement of backlight is controlled by presetting the backlight gain value, and if the gain is applied to the backlight brightness of a subarea, then the backlight brightness of a dark scene may be lowered to thereby eliminate the phenomenon of black "floating" arising from the enhancement of backlight so as to alleviate the contrast quality of picture from being deteriorated due to the distortion in brightness arising from the improvement to the backlight brightness of the picture at low brightness. In the second embodiment, as illustrated in FIG. 20, before the step S50 in the first embodiment, the method for controlling liquid crystal display brightness further includes:

The step S410 is to determine a subarea backlight value adjustment coefficient, and to further multiply the gained subarea backlight values with the corresponding subarea backlight value adjustment coefficient to obtain adjusted subarea backlight values, where if the pre-obtained subarea backlight value, or the gained subarea backlight value is below a first threshold, then the backlight value adjustment coefficient may be less than 1.

In this embodiment, a preset backlight value adjustment coefficient lookup table is searched for the subarea backlight value adjustment coefficient using the gained subarea backlight value or the pre-obtained subarea backlight value, where a correspondence relationship between the backlight value and the adjustment coefficient is recorded in the adjustment coefficient lookup table.

Particularly in this second embodiment, the backlight value adjustment coefficient lookup table is pre-stored, and searched for the subarea backlight value adjustment coefficient using the gained subarea backlight value or the pre-obtained subarea backlight value, where the correspondence relationship between the subarea backlight value and the adjustment coefficient recorded in the adjustment coefficient lookup table can be the correspondence relationship between the pre-obtained subarea backlight value and the adjustment coefficient, or the correspondence relationship between the gained subarea backlight value and the adjustment coefficient, although this embodiment will not be limited thereto. Here the backlight value corresponds to the adjustment coefficient in a one-to-one manner in the correspondence relationship, where different backlight values correspond to different adjustment coefficients. In order to eliminate the problem of black "floating" arising from the enhancement of backlight, if the subarea backlight value is low, particularly if the subarea backlight value is below the first threshold, then the backlight adjustment coefficient may be less than 1, so if the backlight value is low, then the gained subarea backlight value in the subarea may be further multiplied with the adjustment coefficient less than 1, so that the subarea backlight may be lowered relative to the gained backlight value, to thereby alleviate the problem of black "floating" in the part of the dark scene in the picture arising from the gain being applied to the backlight.

Figure 10:
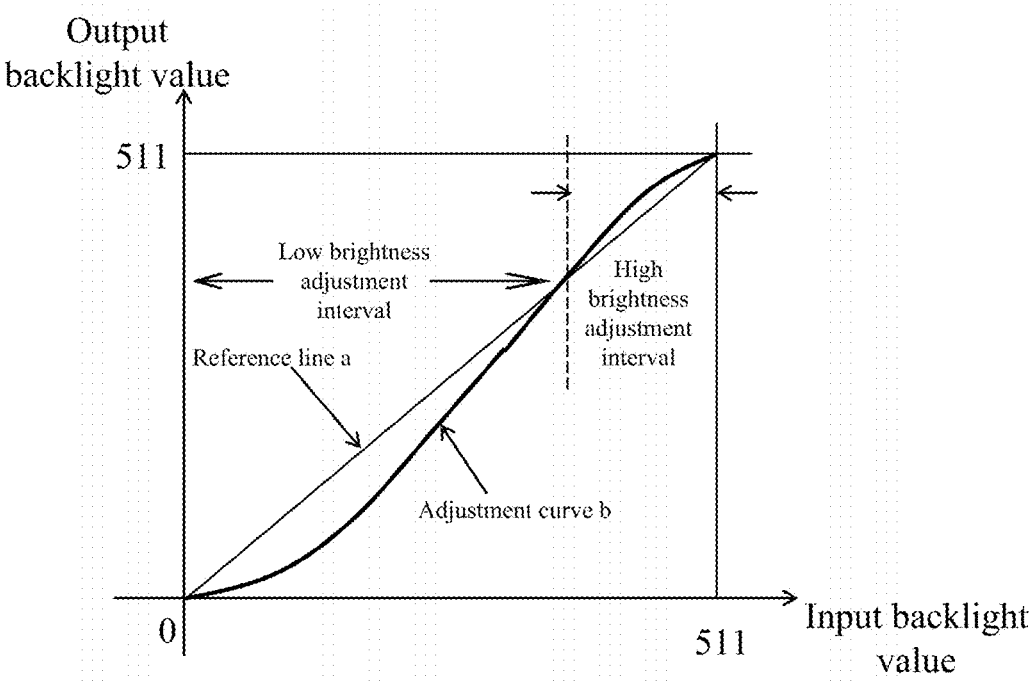
FIG. 10 is a schematic diagram of a backlight value adjustment curve according to an embodiment of this disclosure.

Furthermore in other embodiments of this disclosure, as illustrated in FIG. 10 which is a schematic diagram of a backlight value adjustment curve according to the second embodiment of this disclosure, an adjustment curve b of the adjustment coefficient can be an "S"-like curve, where the traversal axis represents an input backlight value, the vertical axis represents an output backlight value, the adjustment coefficient is the ratio of the output backlight value to the input backlight value, and a reference line a represents a reference line with the adjustment coefficient of 1. Here a low subarea backlight value lies in the low brightness adjustment interval, and a high subarea backlight value lies in the high brightness adjustment interval; and the low brightness adjustment interval and the high brightness adjustment interval are divided based on the input backlight value on the traversal axis. The adjustment coefficient of less than 1 in the low brightness adjustment interval lies below the reference line a; and the adjustment coefficient of more than 1 in the high brightness adjustment interval lies above the reference line a, respectively. In other words, in the backlight subarea with low backlight brightness, the backlight value of the backlight subarea may be lowered in order to address the problem of floating black in the picture arising from the backlight gain; and in the subarea with high backlight brightness, the backlight value can be further increased, where the adjustment coefficient of the backlight subarea is more than 1.

It shall be noted that those skilled in the art can select the range of the low brightness adjustment interval and the range of the high brightness adjustment interval as particularly required for the design, for example, the input backlight value in the low brightness adjustment interval ranges from 0 to 100 in grayscale, and the adjustment coefficient in the interval of the grayscales 0 to 100 varies in such a trend that it firstly decreases from 1 to the minimum value gradually, and then increases from the minimum value to 1 gradually, where the minimum value can be set as required for the design, and the trend curve of the varying adjustment coefficient can be a fold line or a smooth curve.

It shall be further noted that the high brightness adjustment interval and the low brightness adjustment interval may or may not have common endpoints. If they have no common endpoints, then there may be an area in which the adjustment coefficient is 1, between the high brightness adjustment interval and the low brightness adjustment interval. Moreover in the high brightness adjustment interval, if the input backlight value is the pre-obtained subarea backlight value ranging from A to 255; or if the input backlight value is the gained subarea backlight value ranging from B to the maximum gained backlight value, where the gain coefficient is 2, then the maximum gained backlight value may be 511, and the value of A or B can be selected by those skilled in the art as required for the design. The adjustment coefficient in the high brightness adjustment interval varies in such a trend that it firstly increases from 1 to the maximum value gradually, and then decreases from the maximum value to 1 gradually, where the maximum value can be set as required for the design, and the trend curve of the varying adjustment coefficient can be a fold line or a smooth curve.

On one hand, this second embodiment provides a method for controlling liquid crystal display brightness, where the lookup table is pre-stored, and searched for the subarea backlight value adjustment coefficient using the input subarea backlight value, and then the gained backlight value of the subarea is further multiplied with the corresponding adjustment coefficient to obtain the adjusted backlight value of the subarea, where in the lookup table, if the input backlight value is below the first threshold, then the adjustment coefficient may be less than 1. Since the backlight value in the backlight subarea of the picture at low brightness with the gained backlight value is multiplied with the adjustment coefficient less than 1, the backlight brightness in the backlight subarea of the picture at low brightness can be lowered to thereby address the problem of distortion in display brightness arising from the backlight gain and improve the effect of the contrast of the displayed picture as a whole.

On the other hand, while pictures of a frame of image are being displayed, the pictures of the image typically include both pictures of scenes at low brightness and pictures of scenes at high brightness. In a particular implementation of the second embodiment, a gain at the same amplitude proportion can be applied to subarea backlight values of the pictures of scenes at low brightness and the pictures of scenes at high brightness, but for a backlight subarea in the area of a picture of scene at low brightness, the backlight brightness in the backlight subarea at low brightness can be lowered in order to address the problem of overall "floating black" in the picture at low brightness. Although the problem of "floating black" due to the gain to the backlight value of the backlight subarea in the picture at low brightness can be addressed, details of the picture in the area at low brightness may not be well presented, so these details of the picture may be lost.

Furthermore, further to the second embodiment, in order to address the problem of lost details in the picture at low brightness due to the lowered backlight brightness, a third embodiment of this disclosure further provides a method for controlling liquid crystal display brightness, where the image grayscale of each pixel displayed in the area of the picture at low brightness can be compensated for to thereby enhance the sense of hierarchal brightness of the displayed pixels in the picture. The method for controlling liquid crystal display brightness particularly further includes:

The step S60 is to determine a subarea image data block with the adjusted subarea backlight value below the first threshold, and to compensate for the grayscale value of each image pixel in the subarea image data block using a preset grayscale compensation coefficient larger than 1.

In this embodiment, a preset grayscale compensation coefficient lookup table is searched for the compensation coefficient using the grayscale value of the subarea image data block, where a correspondence relationship between the grayscale value and the compensation coefficient is recorded in the grayscale compensation coefficient lookup table.

Particularly in this third embodiment, the image grayscale compensation coefficient lookup table can be pre-stored, and searched for the grayscale compensation coefficient using the grayscale value of the subarea image data block, where the correspondence relationship between the image grayscale value and the compensation coefficient is recorded in the grayscale compensation coefficient lookup table. Here the image grayscale value corresponds to the compensation coefficient in a one-to-one manner in the correspondence relationship, and different image grayscale values correspond to different compensation coefficients. In order to alleviate the problem of the lost details in the picture at low brightness, if the subarea backlight value is so small that it is below the first threshold, then the compensation coefficient is larger than 1, thus the grayscale brightness of the respective pixels in the picture in the backlight subarea of the picture at low brightness can be compensated for respectively so that there will be a sense of hierarchal display brightness between the respective pixels in the subarea, thereby alleviating the problem of the lost details in the picture at low brightness in the second embodiment.

By way of an example, for example, the black image with the grayscale value of 0 in "reference black" is multiplied with the compensation coefficient larger than 1 to obtain the compensated image which still is a black image with the grayscale value of 0, thus eliminating the problem of "black floating" of "reference black"; and the image with a higher grayscale value than "reference black", e.g., an image at low brightness with the grayscale of 6, is multiplied with the compensation coefficient larger than 2 to obtain an image at low brightness with the grayscale of 12, thus improving the sense of hierarchal brightness between the image at low brightness and the reference black.

It shall be noted in the first embodiment, in order to improve the peak brightness in the backlight subareas, the same frame of image can be displayed by applying the backlight gain at the same amplitude proportion to all the backlight subareas to thereby address the problem of insufficient peak brightness in the backlight subareas and of consequential poor presentation of the peak brightness of the entire image, but if the significant gain of backlight brightness is applied to the area of the picture at low brightness, then the problem of "black floating" in the backlight subareas of the picture at low brightness may come therewith.

In the second embodiment, in order to address the problem of "black floating" in the backlight subareas of the picture at low brightness in the first embodiment, the backlight brightness of the backlight subareas of the picture at low brightness are lowered so that the same frame of pictures can be displayed by applying different backlight gain proportions to different backlight subareas in such a way that gain proportion amplitudes of backlight values of backlight subareas in a picture at low brightness are smaller, and gain proportion amplitudes of backlight values of backlight subareas in a picture at high brightness are larger, thus addressing the problem of "black floating" in the backlight subareas of the picture at low brightness in the first embodiment, but in this embodiment, the same frame of pictures are displayed by applying different backlight gain amplitudes to different areas of pictures, and the backlight brightness is low particularly in the picture at low brightness, so the sense of hierarchy in the picture may not be sufficient.

In this third embodiment, in order to address the problem of the insufficient sense of hierarchy in the picture at low brightness in the second embodiment, the grayscale values of the respective pixels in the image in the display area of the picture at low brightness are enhanced respectively for compensation to thereby enhance the sense of hierarchy between the respective pixels of the image, and the sense of hierarchical display brightness is improved due to the backlight gain in the area of the picture at high brightness, so that there will be a strong hierarchy of displayed details of the global image. In other words, the grayscales of the respective pixels in the same frame of displayed pictures can be compensated for to thereby guarantee the sense of hierarchy in the areas of the pictures at low brightness, and the gain can be applied to the backlight peak brightness to thereby guarantee the sense of hierarchy in the areas of the pictures at high brightness, so that the sense of hierarchy in the pictures can be improved as a whole.

It shall be further noted that as can be apparent from the analysis above in this third embodiment, if the gain is applied to the backlight in the area of the picture at low brightness, then the problem of "black floating" will come therewith, and since the backlight brightness thereof is not a bottleneck limiting the contrast of the picture, the grayscale values of the pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the contrast of the picture in the area of the picture at high brightness is insufficient backlight peak brightness; and if the grayscale values of the pixels in the image are compensated for, then the brightness of the displayed image cannot be improved due to the limited maximum backlight peak brightness, so the backlight peak brightness will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight subarea in an area of a picture at high brightness to improve the sense of hierarchy in the picture, so that the overall sense of hierarchy in the image can be improved to thereby improve the effect of the dynamic contrast of the pictures.

Figure 11:
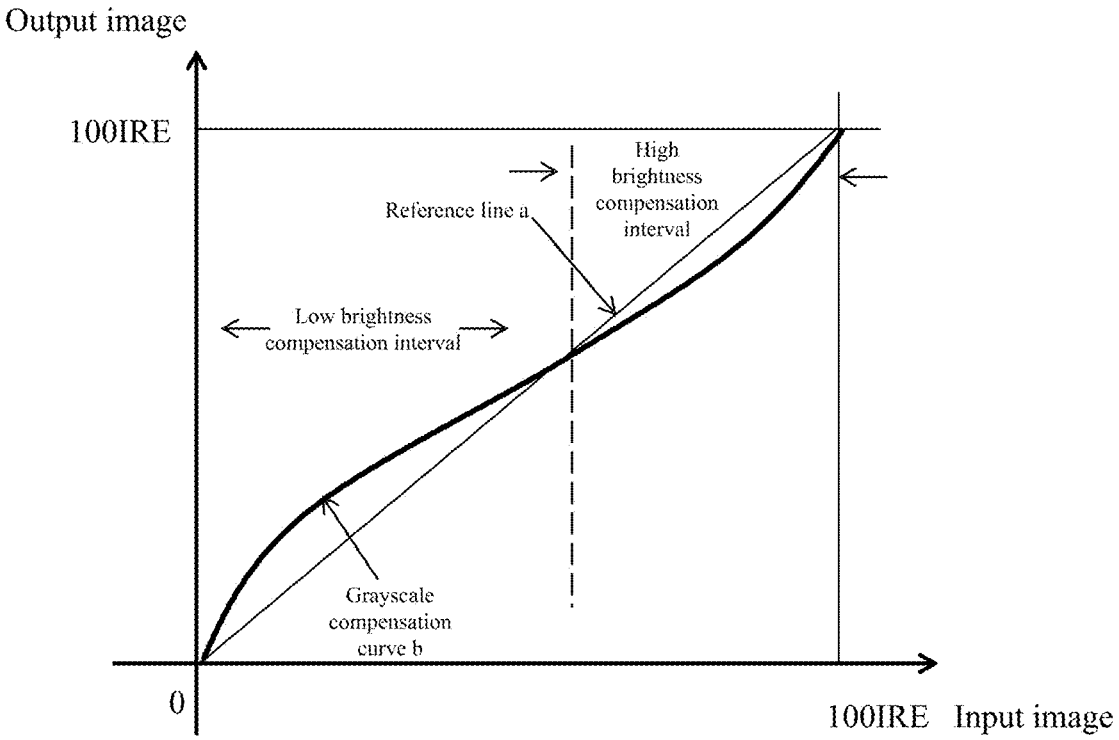
FIG. 11 is a schematic diagram of an image grayscale compensation curve according to an embodiment of this disclosure.

Furthermore in another embodiment of this disclosure, as illustrated in FIG. 11 which is a schematic diagram of an image grayscale compensation curve according to the third embodiment of this disclosure, a grayscale compensation curve b is an inverted "S"-like curve, where the traversal axis represents an input grayscale value, the vertical axis represents an output grayscale value, the compensation coefficient is the ratio of output image brightness to input image brightness, and a reference line a represents a reference line with the compensation coefficient of 1. Here low input image brightness lies in a low brightness compensation interval, and high input image brightness lies in a high brightness compensation interval; and the low brightness compensation interval and the high brightness compensation interval are divided by a threshold of the input image brightness value on the traversal axis. The compensation coefficient of less than 1 in the low brightness compensation interval lies below the reference line a; and the compensation coefficient of more than 1 in the high brightness compensation interval lies above the reference line a, respectively.

In other words, in a subarea of a picture at low brightness, in order to address an improvement of the sense of hierarchy in the displayed image, grayscale brightness of respective image pixels in the subarea maybe improved differently; and in a subarea of a picture at high brightness, backlight brightness is also improved in this third embodiment, and in order to prevent display brightness of the image from being saturated due to the improvement of the backlight peak brightness, and the hierarchy at high brightness from being consequentially degraded, a compensation coefficient of this area will be less than 1, and the grayscale brightness of the respective image pixels in the subarea can be lowered differently to thereby alleviate the problem of the peak brightness being saturated due to the improved backlight values.

It shall be noted that those skilled in the art can select the range of the low brightness compensation interval and the range of the high brightness compensation interval as particularly required for the design. Moreover the varying trend of the curve can be a fold line or a smooth curve, and the compensation coefficient in the high brightness compensation interval varies in such a trend that it firstly decreases from 1 to the minimum value gradually, and then increases from the minimum value to 1 gradually, and the compensation coefficient in the low brightness compensation interval varies in such a trend that it firstly increases from 1 to the maximum value gradually, and then decreases from the maximum value to 1 gradually, where the minimum value and the maximum value can be set as required for the design.

Figure 12:
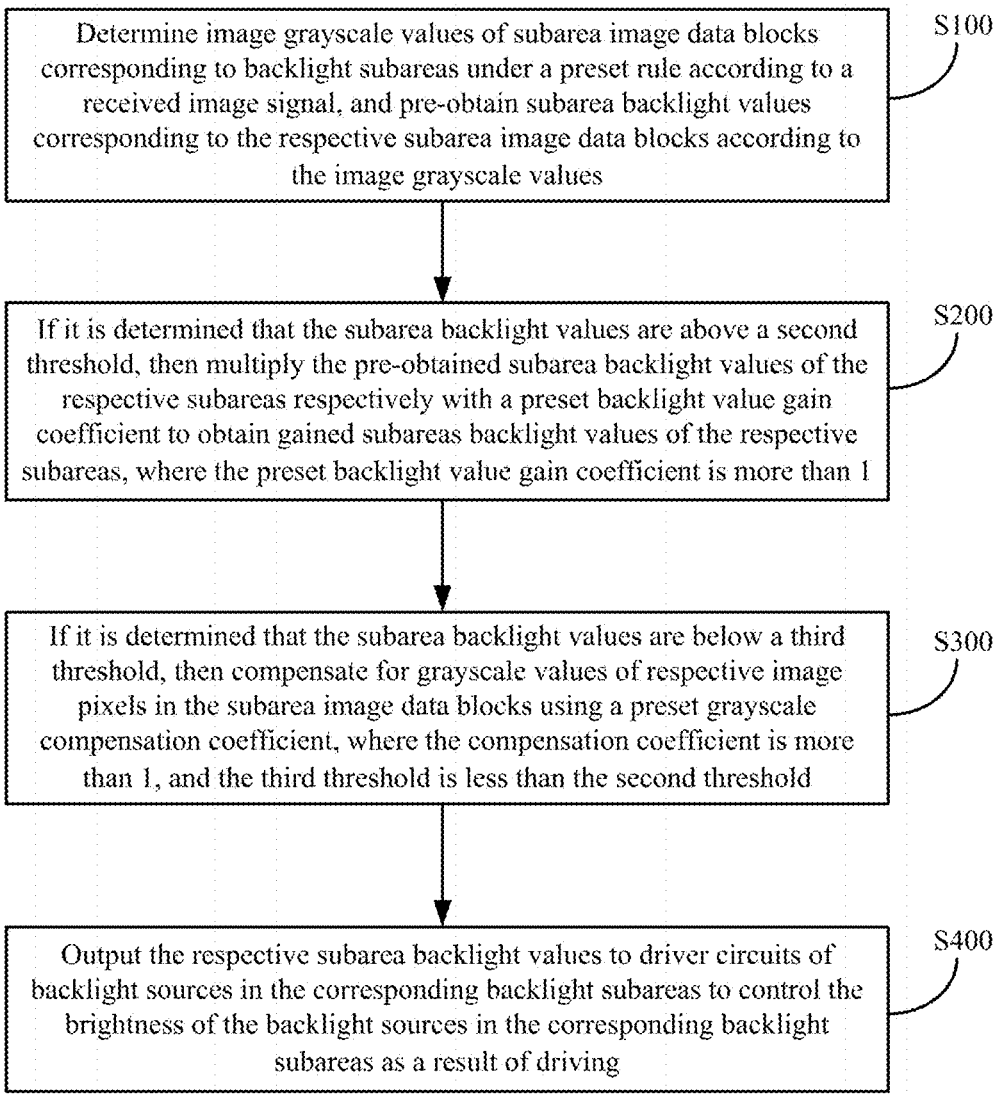
FIG. 12 is a schematic flow chart of another method for controlling liquid crystal display brightness according to an embodiment of this disclosure.

Furthermore in connection with the methods for controlling liquid crystal display brightness according to the first embodiment, the second embodiment, and the third embodiment, a fourth embodiment of this disclosure provides a variation in which there is provided a method for controlling liquid crystal display brightness according to the fourth embodiment, and as illustrated in FIG. 12 which is a schematic flow chart of another method for controlling liquid crystal display brightness according to the fourth embodiment of this disclosure, the method for controlling liquid crystal display brightness includes:

The step S100 is to determine image grayscale values of subarea image data blocks corresponding to backlight subareas under a preset rule according to a received image signal, and to pre-obtain subarea backlight values corresponding to the subarea image data blocks according to the image grayscale values of the subarea image data blocks.

This step can be performed particularly as in the first embodiment, so a repeated description thereof will be omitted here.

The step S200 is, if the subarea backlight values are above a second threshold, to multiply the pre-obtained subarea backlight values with a preset backlight value gain coefficient to obtain gained backlight values of the backlight subareas, where the preset backlight value gain coefficient is more than 1.

In this fourth embodiment, it is determined whether the backlight values of the respective subareas are above the second threshold, and if so, which indicates that pictures of an image in the subareas are brighter, then the gain may be applied to the backlight values to thereby improve the sense of hierarchy in the displayed pictures of the subareas, and particularly the pre-obtained subarea backlight values may be multiplied with the preset backlight value gain coefficient to obtain the gained backlight values of the backlight subareas, where the preset backlight value gain coefficient is more than 1.

The gain can be applied to the backlight values in this step particularly as the first embodiment, and particularly the subarea backlight values are multiplied respectively with the preset backlight value gain coefficient to obtain the gained backlight values of the respective backlight subareas. Since the preset backlight value gain coefficient is more than 1, then the gained backlight values of the respective backlight subareas as a result of the multiplication are more than the pre-obtained subarea backlight values, so that if the backlight of the subareas is driven using the gained backlight values, then the peak brightness can be improved, and as can be apparent from the analysis above, the improvement of the peak brightness in the subareas can enhance the contrast of the displayed pictures of the image.

The step S300 is, if it is determined that the subarea backlight values are below a third threshold, to compensate for grayscale values of respective image pixels in the subarea image data blocks using a preset grayscale compensation coefficient, where the compensation coefficient is more than 1, and the third threshold is less than the second threshold.

In this fourth embodiment, if the subarea backlight values are below the third threshold, which indicates that pictures of an image in the subareas are darker, then the image may be compensated for to thereby improve the sense of hierarchy in the displayed pictures of the subareas, and particularly the grayscale values of the respective image pixels in the subarea image data blocks are compensated in grayscale using the preset grayscale compensation coefficient more than 1.

The image can be compensated for in this step particularly as in the third embodiment, and particularly a preset grayscale compensation coefficient lookup table is searched for the compensation coefficient using the grayscale value of the subarea image data block, where the correspondence relationship between the grayscale value and the compensation coefficient is recorded in the grayscale compensation coefficient lookup table. The image grayscale compensation coefficient lookup table can be pre-stored, and searched for the grayscale compensation coefficient using the grayscale value of the subarea image data block, where the correspondence relationship between the image grayscale value and the compensation coefficient is recorded in the grayscale compensation coefficient lookup table. Here the image grayscale value corresponds to the compensation coefficient in a one-to-one manner in the correspondence relationship, and different image grayscale values correspond to different compensation coefficients.

The step S400 is to output the respective subarea backlight values to driver circuits of backlight sources in the corresponding backlight subareas to control the brightness of the backlight sources in the corresponding backlight subareas as a result of driving.

This step can be performed particularly as in the first embodiment, so a repeated description thereof will be omitted here.

It shall be noted that in this fourth embodiment, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the display brightness of the image in the area of the picture at high brightness is the backlight peak brightness; and if the grayscale values of the pixels in the image are compensated for, then the brightness of the displayed image cannot be improved due to the limited maximum backlight peak brightness, so the backlight peak brightness may be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight subarea in an area of a picture at high brightness to improve the sense of hierarchy in the picture, so that the overall sense of hierarchy in the image can be improved to thereby improve the effect of the dynamic contrast of the pictures.

Figure 13:
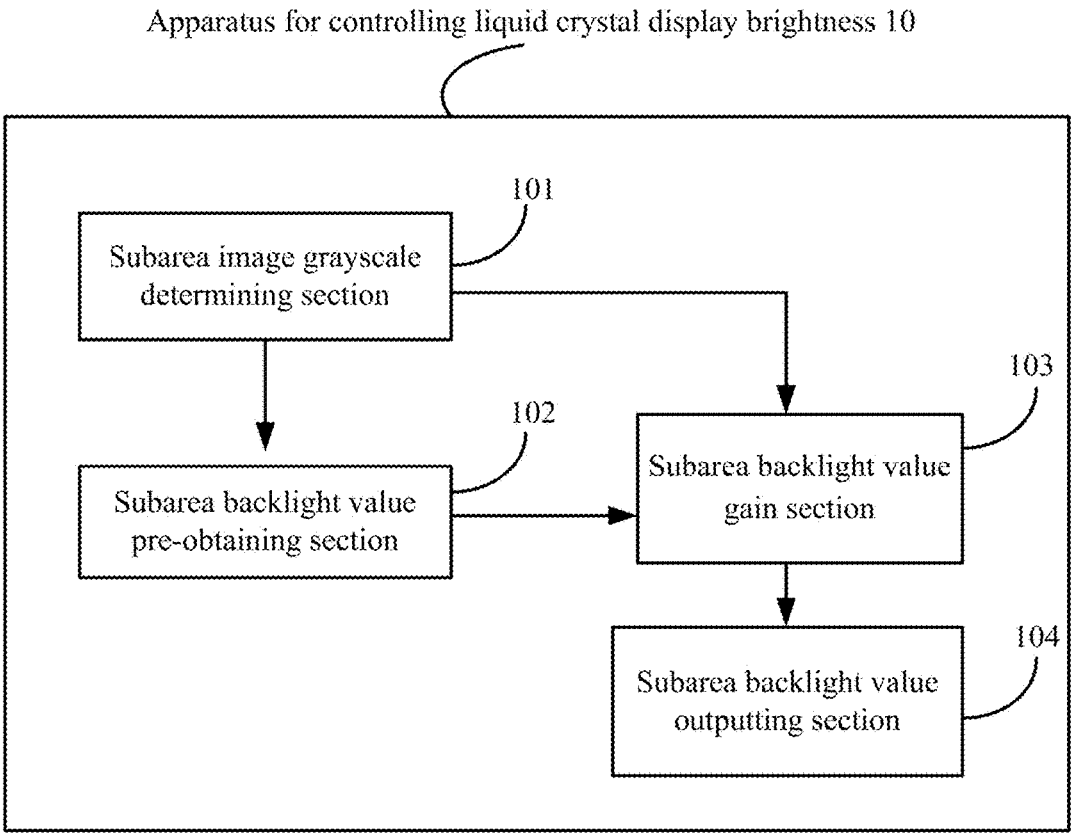
FIG. 13 is a schematic structural diagram of an apparatus for controlling liquid crystal display brightness according to an embodiment of this disclosure.

As illustrated in FIG. 13 which is a schematic structural diagram of an apparatus for controlling liquid crystal display brightness according to a fifth embodiment of this disclosure, the apparatus 10 for controlling liquid crystal display brightness can be a single video processing chip or a plurality of video processing chips, e.g., two video processing chips, and the apparatus 10 for controlling liquid crystal display brightness can include:

A subarea image grayscale determining section 101 is configured to determine image grayscale values of subarea image data blocks corresponding to backlight subareas according to a received image signal.

A subarea backlight value pre-obtaining section 102 is configured to pre-obtain subarea backlight values corresponding to the subarea image data blocks according to the image grayscale values of the subarea image data blocks.

A subarea backlight value gain section 103 is configured to multiply the pre-obtained subarea backlight values with a preset backlight value gain coefficient to obtain gained backlight values of the backlight subareas, where the preset backlight value gain coefficient is more than 1.

A subarea backlight value outputting section 104 is configured to output the respective subarea backlight values to driver circuits of backlight sources in the corresponding backlight subareas to control the brightness of the backlight sources in the corresponding backlight subareas as a result of driving.

For details about the functions and processing flows of the respective modules in the apparatus for controlling liquid crystal display brightness according to this embodiment, reference can be made to the detailed description of the method for controlling liquid crystal display brightness according to the first embodiment above, so a repeated description thereof will be omitted here.

Figure 14:
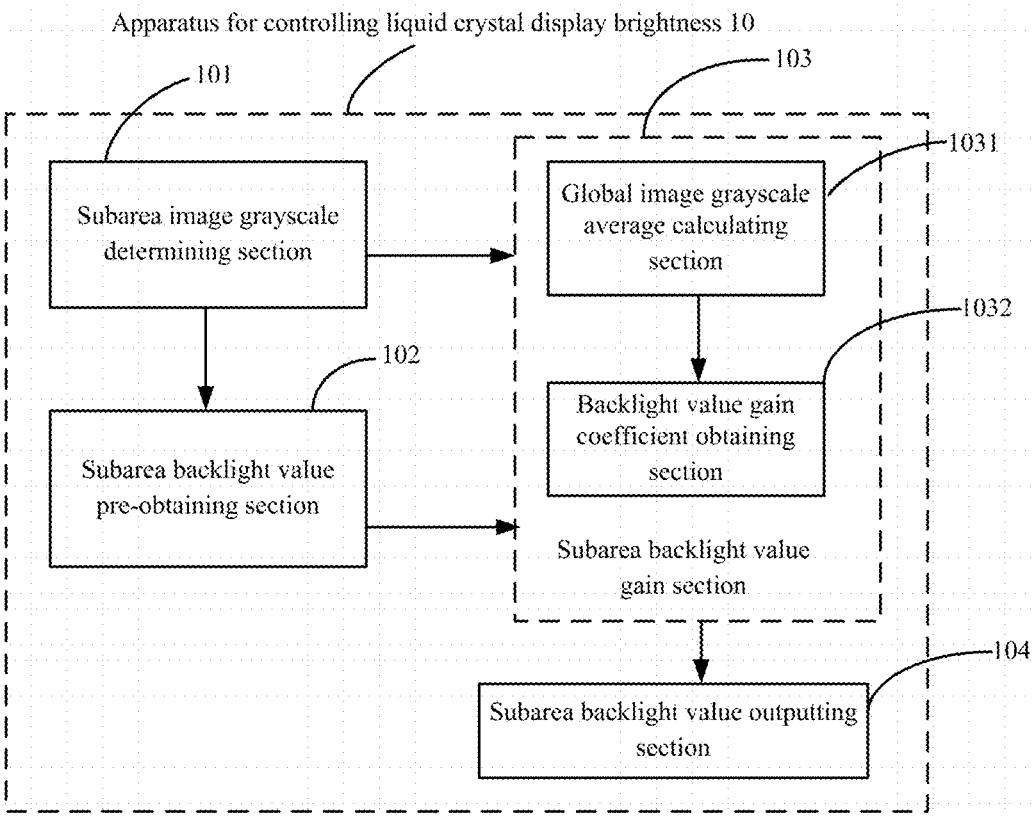
FIG. 14 is a schematic structural diagram of another apparatus for controlling liquid crystal display brightness according to an embodiment of this disclosure.

Optionally as illustrated in FIG. 14 which is a schematic structural diagram of another apparatus for controlling liquid crystal display brightness according to the this fifth embodiment, the subarea backlight value gain section 103 further includes:

A global image grayscale average calculating section 1031 is configured to obtain the average grayscale value of a global image from grayscales of the global image; and A backlight value gain coefficient obtaining module 1032 is configured to determine the backlight value gain coefficient according to a correspondence relationship between the average grayscale value of the global image and the preset backlight value gain coefficient.

The subarea backlight value gain section 103 particularly includes:

A backlight value gain coefficient lookup table in which the correspondence relationship between the average grayscale value of the global image and the preset backlight value gain coefficient is preset.

The subarea backlight value gain section 103 particularly further includes:

A gain curve relationship between the average grayscale value of the image and the backlight value gain coefficient, recorded in the backlight value gain coefficient lookup table, where the gain curve is divided into a low brightness enhancement interval, a high brightness enhancement interval, and a power control interval as the average grayscale value of the image is increasing, and the gain coefficient in the high brightness enhancement interval is more than the gain coefficient in the low brightness enhancement interval and the gain coefficient in the power control interval.

For details about the functions and processing flows of the respective modules in the apparatus for controlling liquid crystal display brightness according to this embodiment, reference can be made to the detailed description of the method for controlling liquid crystal display brightness according to the first embodiment above, so a repeated description thereof will be omitted here.

Figure 15:
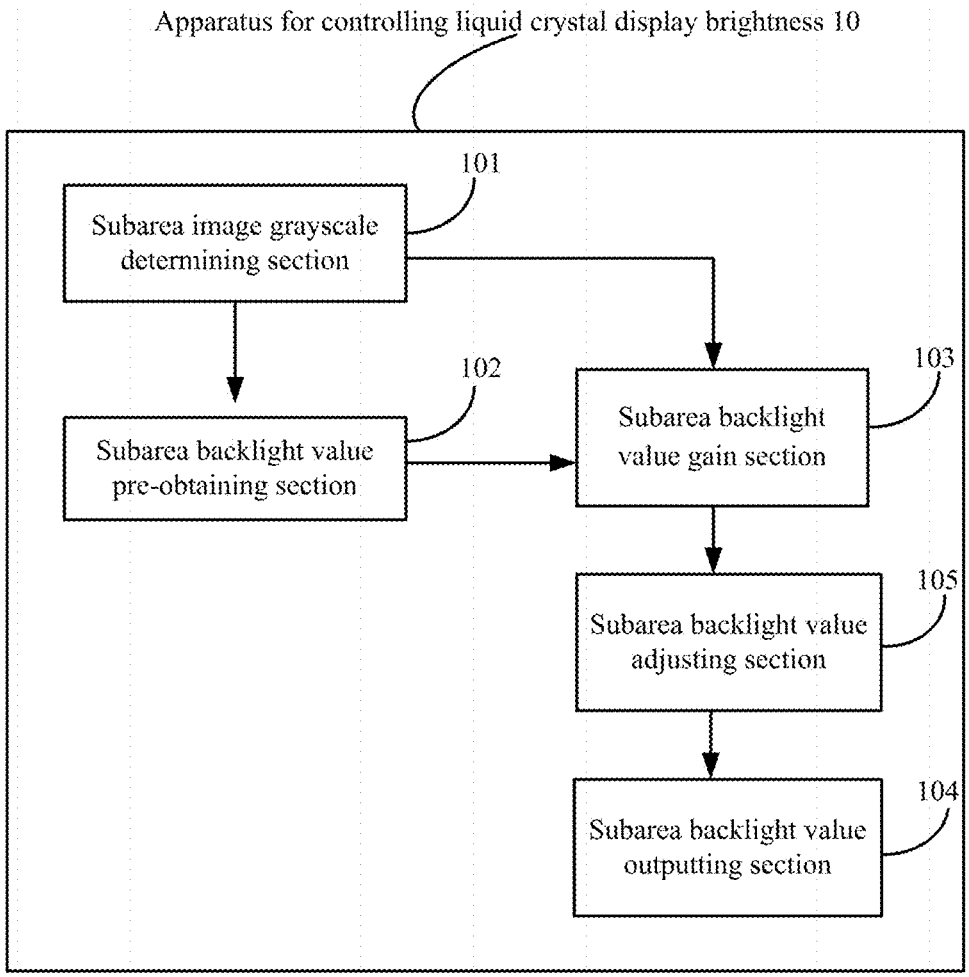
FIG. 15 is a schematic structural diagram of still another apparatus for controlling liquid crystal display brightness according to an embodiment of this disclosure.

As illustrated in FIG. 15 which is a schematic structural diagram of an apparatus for controlling liquid crystal display brightness according to a sixth embodiment of this disclosure, the apparatus 10 for controlling liquid crystal display brightness can be a single video processing chip or a plurality of video processing chips, e.g., two video processing chips, and unlike the fifth embodiment, the apparatus 10 for controlling liquid crystal display brightness further includes between the subarea backlight value gain section 103 and the subarea backlight value outputting section 104:

A subarea backlight value adjusting section 105 is configured to obtain a subarea backlight value adjustment coefficient according to the gained subarea backlight values, and to further multiply the gained backlight values of the backlight subareas, with the corresponding backlight value adjustment coefficient to obtain adjusted subarea backlight values, where if the pre-obtained subarea backlight values or the gained subarea backlight values are below a first threshold, then the backlight value adjustment coefficient is less than 1.

The subarea backlight value adjusting section 105 is further configured:

To search a preset backlight value adjustment coefficient lookup table for the subarea backlight value adjustment coefficient using the gained subarea backlight values, where a correspondence relationship between the subarea backlight value and the adjustment coefficient is recorded in the adjustment coefficient lookup table.

The subarea backlight value adjusting section 105 particularly includes:

A curve of the correspondence relationship between the subarea backlight value and the adjustment coefficient is an "S"-like curve, where the traversal axis of the "S"-like curve represents an input backlight value, and the vertical axis thereof represents an output backlight value.

The functions of the other components in this sixth embodiment are the same as those in the fifth embodiment, so a repeated description thereof will be omitted here.

For details about the functions and processing flows of the respective modules in the apparatus for controlling liquid crystal display brightness according to this sixth embodiment, reference can be made to the detailed description of the method for controlling liquid crystal display brightness according to the second embodiment above, so a repeated description thereof will be omitted here.

Figure 16:
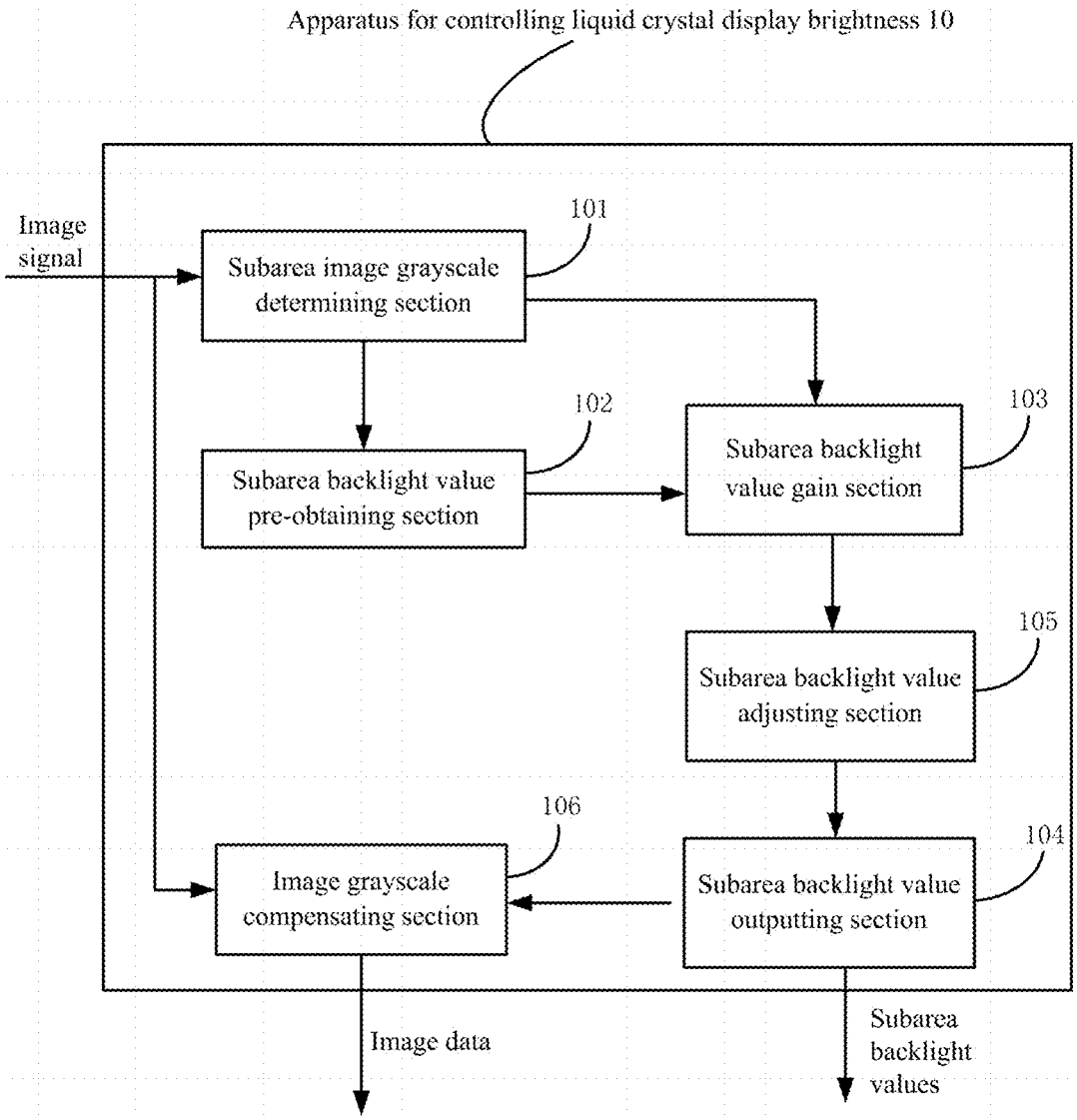
FIG. 16 is a schematic structural diagram of a further apparatus for controlling liquid crystal display brightness according to an embodiment of this disclosure.

As illustrated in FIG. 16 which is a schematic structural diagram of an apparatus for controlling liquid crystal display brightness according to a seventh embodiment of this disclosure, the apparatus 10 for controlling liquid crystal display brightness can be a single video processing chip or a plurality of video processing chips, e.g., two video processing chips, and unlike the sixth embodiment, the apparatus 10 for controlling liquid crystal display brightness further includes:

An image grayscale compensating section 106 is configured to determine a subarea image data block with the adjusted subarea backlight value below the first threshold, and to compensate for the grayscale value of each image pixel in the subarea image data block using a preset grayscale compensation coefficient larger than 1.

The image grayscale compensating section 106 is further configured:

To search a preset grayscale compensation coefficient lookup table for the compensation coefficient using the image grayscale value of the subarea image data block, where a correspondence relationship between the grayscale value and the compensation coefficient is recorded in the grayscale compensation coefficient lookup table.

The image grayscale compensating section 106 further includes:

A compensation curve of the correspondence relationship between the grayscale value and the compensation coefficient is an inverted "S"-like curve, where the traversal axis of the inverted "S"-like curve represents an input grayscale value, and the vertical axis thereof represents an output grayscale value.

In this seventh embodiment, the image grayscale compensating section 106 compensates for the grayscales of the received image signal according to a feedback signal of the subarea backlight value outputting section 104 to obtain compensated image data, and outputs the image data to a timing controller Tcon circuit, and the Tcon circuit generates a driver signal according to the image data to control a liquid crystal panel so as to drive the liquid crystal panel to display the image.

The functions of the other components in this seventh embodiment are the same as those in the sixth embodiment, so a repeated description thereof will be omitted here.

For details about the functions and processing flows of the respective modules in the apparatus for controlling liquid crystal display brightness according to this seventh embodiment, reference can be made to the detailed description of the method for controlling liquid crystal display brightness according to the third embodiment above, so a repeated description thereof will be omitted here.

Figure 17:
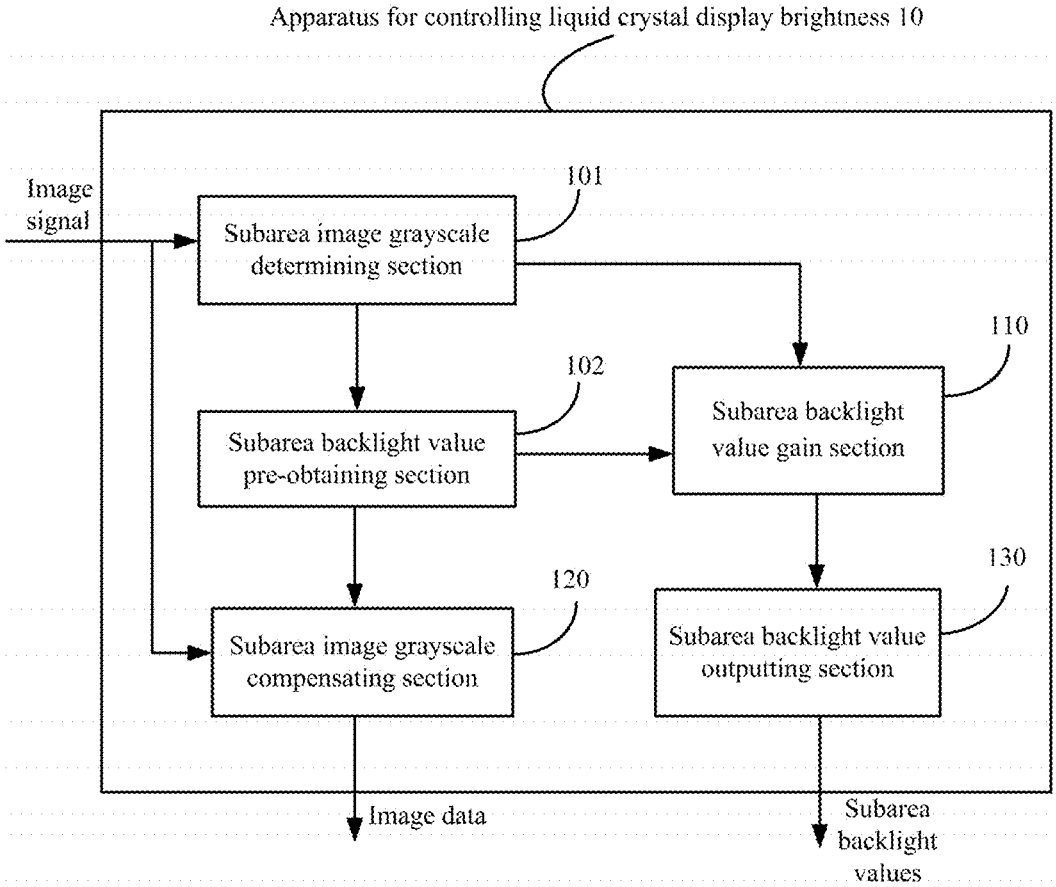
FIG. 17 is a schematic structural diagram of a still further apparatus for controlling liquid crystal display brightness according to an embodiment of this disclosure.

An eighth embodiment of this disclosure provides a variation of the apparatuses for controlling liquid crystal display brightness according to the fifth embodiment, the sixth embodiment, and the seventh embodiment, and as illustrated in FIG. 17 which is a schematic structural diagram of an apparatus for controlling liquid crystal display brightness according to the eighth embodiment of this disclosure, the apparatus 10 for controlling liquid crystal display brightness can be a single video processing chip or a plurality of video processing chips, e.g., two video processing chips, and the apparatus 10 for controlling liquid crystal display brightness further include:

A subarea image grayscale determining section 101 is configured to determine image grayscale values of subarea image data blocks corresponding to backlight subareas under a preset rule according to a received image signal.

A subarea backlight value pre-obtaining section 102 is configured to pre-obtain subarea backlight values corresponding to the subarea image data blocks according to the image grayscale values of the image data blocks.

A subarea backlight value gain section 110 is configured, if it is determined that if the subarea backlight values are above a second threshold, to multiply the pre-obtained subarea backlight values with a preset backlight value gain coefficient to obtain gained backlight values of the backlight subareas, where the preset backlight value gain coefficient is more than 1.

A subarea image grayscale compensating section 120 is configured, if it is determined that the subarea backlight values are below a third threshold, to compensate for grayscale values of respective image pixels in the subarea image data blocks using a preset grayscale compensation coefficient, where the compensation coefficient is more than 1, and the third threshold is less than the second threshold.

A subarea backlight value outputting section 130 is configured to output the respective subarea backlight values to driver circuits of backlight sources in the corresponding backlight subareas to control the brightness of the backlight sources in the corresponding backlight subareas as a result of driving.

For details about the functions and processing flows of the respective modules in the apparatus for controlling liquid crystal display brightness according to this eighth embodiment, reference can be made to the detailed description of the method for controlling liquid crystal display brightness according to the fourth embodiment above, so a repeated description thereof will be omitted here.

In this eighth embodiment, as can be known from the analysis above, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels so that the image data are compensated for driving the liquid crystal panel to display the image, where the different grayscale values of the different pixels are compensated for by different compensation amplitudes, thus improving the difference in brightness between the displayed pictures of the image so as to enhance the sense of hierarchy. A bottleneck limiting the display brightness of the image in the area of the picture at high brightness is the backlight peak brightness; and if the grayscale values of the pixels in the image are compensated for, then the brightness of the displayed image cannot be improved due to the limited maximum backlight peak brightness, so the subarea backlight peak brightness may be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight subarea in an area of a picture at high brightness to improve the sense of hierarchy in the picture, so that the overall sense of hierarchy in the displayed image can be improved to thereby improve the effect of the dynamic contrast of the pictures.

Figure 18:
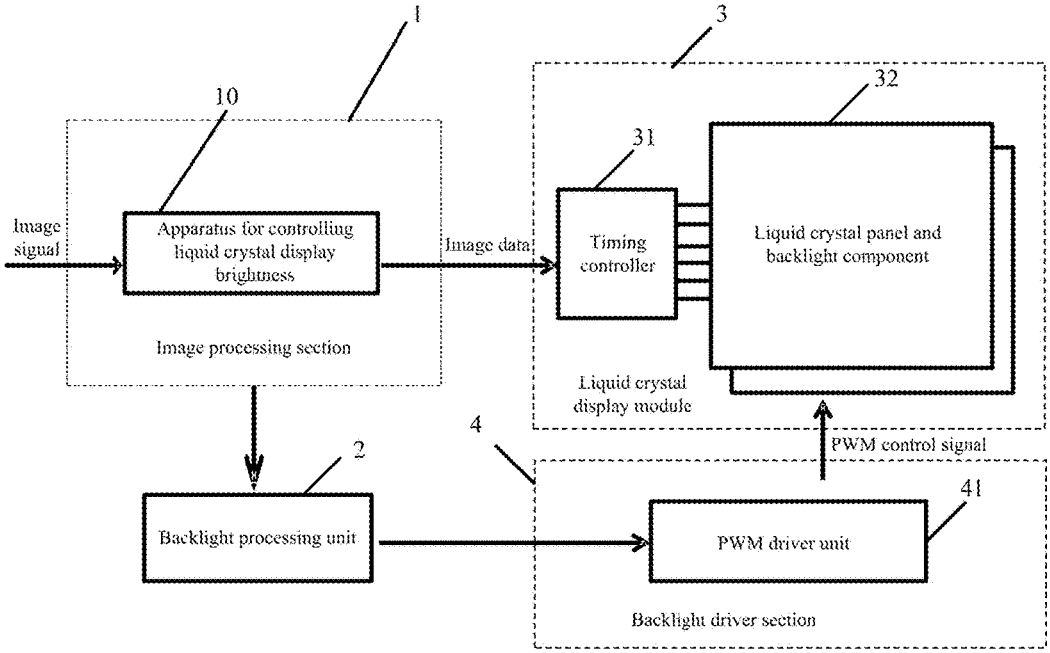
FIG. 18 is a schematic structural diagram of a liquid crystal display device according to an embodiment of this disclosure.

As illustrated in FIG. 18 which is a schematic structural diagram of a liquid crystal display device according to a ninth embodiment of this disclosure, the liquid crystal display device includes an image processing section 1, a memory (not illustrated), a liquid crystal display module 3, a backlight processing unit 2, and a backlight driver section 4, where:

The memory is configured to store programs and various preset lookup table data;

The image processing section 1 includes the apparatus 10 for controlling liquid crystal display brightness configured to execute the programs in the memory, and to invoke the various lookup table data according to the executed programs;

The apparatus 10 for controlling liquid crystal display brightness is further configured to receive an image signal, to process the data, and to output the image data to a timing controller (Tcon) in the liquid crystal display module 3 so that the Tcon generates a driver signal according to the image data to control a liquid crystal panel to display the image;

The apparatus 10 for controlling liquid crystal display brightness is further configured to output subarea backlight values to the backlight processing unit 2 according to the image signal;

The backlight processing unit 2 is configured to determine duty ratios of corresponding PWM signals according to the respective subarea backlight values, and to output the duty ratios to a PWM driver unit 41 in the backlight driver section 4; and The PWM driver unit 41 is configured to generate PWM control signals to control backlight sources of corresponding subareas in the backlight component 32.

Here the apparatus 10 for controlling liquid crystal display brightness is any one of the apparatuses 10 for controlling liquid crystal display brightness according to the fifth embodiment to the eighth embodiment, so a repeated description of the particular functions of the apparatus 10 for controlling liquid crystal display brightness is will be omitted here.

An embodiment of this disclosure further provides an apparatus for controlling liquid crystal display brightness, which includes a memory and a processor, where codes are stored in the memory, and the processor executes the codes to perform:

Determining image grayscale values of subarea image data blocks corresponding to backlight subareas according to a received image signal;

Pre-obtaining subarea backlight values corresponding to the subarea image data blocks according to the image grayscale values of the subarea image data blocks;

Multiplying the pre-obtained subarea backlight values with a preset backlight value gain coefficient to obtain gained backlight values of the backlight subareas, where the preset backlight value gain coefficient is more than 1; and Outputting the respective gained subarea backlight values to driver circuits of backlight sources in the corresponding backlight subareas to control the brightness of the backlight sources in the corresponding backlight subareas as a result of driving.

Optionally the preset backlight value gain coefficient is obtained by:

Obtaining an average grayscale value of a global image according to grayscales of the global image; and Determining the backlight value gain coefficient according to a correspondence relationship between the average grayscale value of the global image and the preset backlight value gain coefficient.

Optionally the correspondence relationship between the average grayscale value of the global image and the preset backlight value gain coefficient is preset in a backlight value gain coefficient lookup table.

Optionally a gain curve relationship between the average grayscale value of the image and the backlight value gain coefficient is recorded in the backlight value gain coefficient lookup table, where the gain curve is divided into a low brightness enhancement interval, a high brightness enhancement interval, and a power control interval as the average grayscale value of the image is increasing, and the gain coefficient in the high brightness enhancement interval is more than the gain coefficient in the low brightness enhancement interval and the gain coefficient in the power control interval.

Optionally the processor is further configured to execute the codes to perform:

Determine a subarea backlight value adjustment coefficient, and further multiplying the gained subarea backlight values with the corresponding backlight value adjustment coefficient to obtain adjusted subarea backlight values, where if the pre-obtained subarea backlight values or the gained subarea backlight values are below a first threshold, then the backlight value adjustment coefficient is less than 1; and Outputting the adjusted respective subarea backlight values to driver circuits of backlight sources in the corresponding backlight subareas to control the brightness of the backlight sources in the corresponding backlight subareas as a result of driving.

Optionally the backlight value adjustment coefficient is obtained by:

Searching a preset backlight value adjustment coefficient lookup table for the subarea backlight value adjustment coefficient using the gained subarea backlight values, where a correspondence relationship between the subarea backlight value and the adjustment coefficient is recorded in the adjustment coefficient lookup table.

Optionally a curve of the correspondence relationship between the backlight value and the adjustment coefficient is an "S"-like curve, where the traversal axis of the "S"-like curve represents an input backlight value, and the vertical axis thereof represents an output backlight value.

Optionally the processor is further configured to execute the codes to perform:

Determining a subarea image data block with the adjusted subarea backlight value below the first threshold, and compensating for the grayscale value of each image pixel in the subarea image data block using a preset grayscale compensation coefficient larger than 1.

Optionally the compensation coefficient is obtained by:

Searching a preset grayscale compensation coefficient lookup table for the compensation coefficient using the image grayscale value of the subarea image data block, where a correspondence relationship between the grayscale value and the compensation coefficient is recorded in the grayscale compensation coefficient lookup table Optionally a compensation curve of the correspondence relationship between the grayscale value and the compensation coefficient is an inverted "S"-like curve, where the traversal axis of the inverted "S"-like curve represents an input grayscale value, and the vertical axis thereof represents an output grayscale value.

Figure 19:
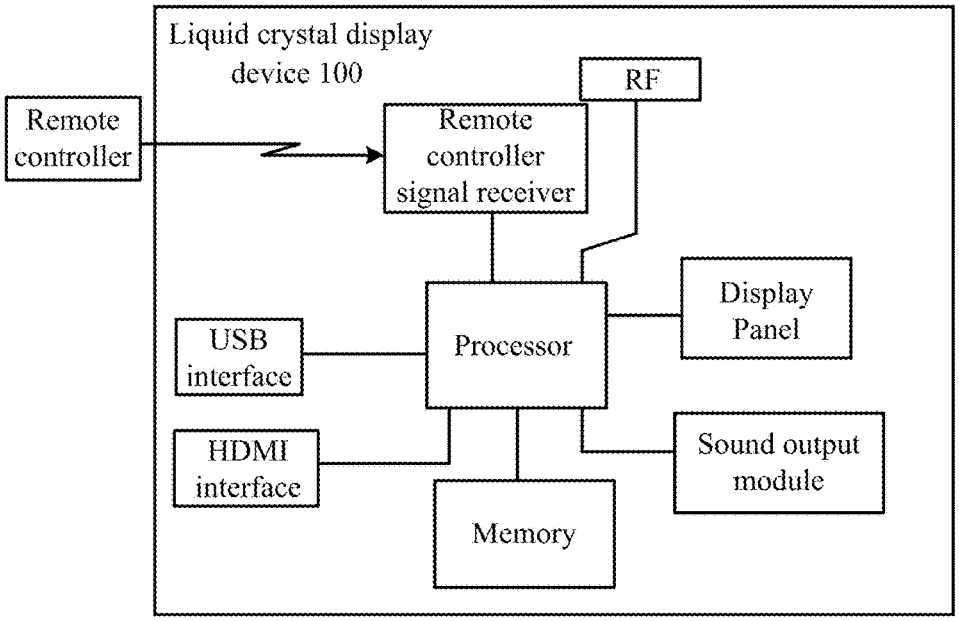
FIG. 19 is a schematic structural diagram of a liquid crystal display device according to some embodiments of this disclosure.

FIG. 19 illustrates a schematic structural diagram of a liquid crystal display device according to some embodiments of this disclosure, where the liquid crystal display device 100 can include a memory, an input unit, an output unit, one or more processors, and other components. Those skilled in the art can appreciate that the liquid crystal display device will not be limited to the structure of the liquid crystal display device illustrated in FIG. 19, but can include more or less components than those as illustrated or some of the components can be combined or different components can be arranged, where:

The memory can be configured to store software programs and modules, and the processor can be configured to run the software programs and modules stored in the memory to thereby perform various function applications and data processing. The memory can include a high-speed random access memory and can further include a nonvolatile memory, e.g., at least one magnetic-disk memory device, a flash memory device or another volatile solid memory device. Moreover the memory can further include a memory controller configured to provide an access of the processor and the input unit to the memory.

The processor is a control center of the liquid crystal display device, has the respective components of the entire liquid crystal display device connected by various interfaces and lines, and runs or executes the software programs and/or the modules stored in the memory and invokes the data stored in the memory to perform the various functions of the liquid crystal display device 100 and process the data to thereby manage and control the liquid crystal display device as a whole. Optionally the processor can include one or more processing cores; and preferably the processor can be integrated with an application processor and a modem processor, where the application processor generally handles the operating system, the user interfaces, the applications, etc., and the modem processor generally handles wireless communication. As can be appreciated, the modem processor may not be integrated into the processor.

The liquid crystal display device 100 can include a TV and radio receiver, a High-Definition Multimedia (HDMI) interface, a USB interface, an audio and video input interface, and other input units, and the input units can further include a remote control receiver to receive a signal sent by a remote controller. Moreover the input units can further include a touch sensitive surface and other input devices, where the touch sensitive surface can be embodied in various types of resistive, capacitive, infrared, surface sound wave and other types, and the other input device can include but will not be limited to one or more of a physical keyboard, functional keys (e.g., a power-on or-off press key, etc.), a track ball, a mouse, a joystick, etc.

The output unit is configured to output an audio signal, a video signal, an alert signal, a vibration signal, etc. The output unit can include a display panel, a sound output module, etc. The display panel can be configured to display information input by a user or information provided to the user and various graphic user interfaces of the liquid crystal display device 100, where these graphic user interfaces can be composed of graphics, texts, icons, videos and any combination thereof. For example, the display panel can be embodied as a Liquid Crystal Display (LCD), an Organic Light-Emitting Diode (OLED), a flexible display, a 3D display, a CRT, a plasmas display panel, etc.

The liquid crystal display device 100 can further include at least one sensor (not illustrated), e.g., an optical sensor, a motion sensor and other sensors. Particularly the optical sensor can include an ambient optical sensor and a proximity sensor, where the ambient optical sensor can adjust the brightness of the display panel according to the luminosity of ambient light rays, and the proximity sensor can power off the display panel and/or a backlight when the liquid crystal display device 100 moves to some position. The liquid crystal display device 100 can be further configured with a gyroscope, a barometer, a hygrometer, a thermometer, an infrared sensor and other sensors.

The liquid crystal display device 100 can further include an audio circuit (not illustrated), and a speaker and a transducer can provide an audio interface between the user and the liquid crystal display device 100. The audio circuit can convert received audio data into an electric signal and transmit the electric signal to the speaker, which is converted by the speaker into an audio signal for output; and on the other hand, the transducer converts a collected audio signal into an electric signal which is received by the audio circuit and then converted into audio data, and the audio data is further output to the processor for processing and then transmitted to another terminal, for example, or the audio data is output to the memory or further processing. The audio circuit may further include an earphone jack for communication between a peripheral earphone and the liquid crystal display device 100.

Moreover the liquid crystal display device 100 can further include a Radio Frequency (RF) circuit. The RF circuit can be configured to receive and transmit a signal. Typically the RF circuit includes but will not be limited to an antenna, at least one amplifier, a tuner, one or more oscillators, a Subscriber Identifier Module (SIM) card, a transceiver, a coupler, a Low Noise Amplifier (LNA), a duplexer, etc. Moreover the liquid crystal display device 100 can further include a web cam, a Bluetooth module, etc.

Moreover the liquid crystal display device 100 further includes a Wireless Fidelity (WiFi) module (not illustrated). The WiFi is a technology of short-range wireless transmission, and the liquid crystal display device 100 can assist the user in transmitting and receiving an email, browsing a web page, accessing streaming media, etc., and also provide the user with a wireless broadband access to the Internet, through the WiFi module. Although the WiFi module is illustrated in FIG. 6, it can be appreciated that it may not necessarily be included in the liquid crystal display device 100 but can be omitted as required without departing from the scope of the spirit of this disclosure.

Those ordinarily skilled in the art can appreciate that all or a part of the steps in the methods according to the embodiments described above can be performed by program instructing relevant hardware, where the programs can be stored in a computer readable storage medium, and the programs can perform one or a combination of the steps in the method embodiments upon being executed; and the storage medium includes an ROM, an RAM, a magnetic disc, an optical disk, or any other medium which can store program codes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An apparatus for controlling liquid crystal display brightness, the apparatus comprising:

a subarea image grayscale determining section configured to determine image grayscale values of subarea image data blocks corresponding to backlight subareas according to a received image signal;

a subarea backlight value pre-obtaining section configured to pre-obtain subarea backlight values corresponding to the subarea image data blocks according to the image grayscale values of the subarea image data blocks;

a subarea backlight value gain section configured to multiply the pre-obtained subarea backlight values with a preset backlight value gain coefficient to obtain gained backlight values of the backlight subareas, wherein the preset backlight value gain coefficient is more than 1;

a subarea backlight value outputting section configured to output the respective gained subarea backlight values to driver circuits of backlight sources in the corresponding backlight subareas to control the brightness of the backlight sources in the corresponding backlight subareas as a result of driving;

a subarea backlight value adjusting section configured to determine a subarea backlight value adjustment coefficient, and to further multiply the gained subarea backlight values with the corresponding backlight value adjustment coefficient to obtain adjusted subarea backlight values, wherein if the pre-obtained subarea backlight values or the gained subarea backlight values are below a first threshold, then the backlight value adjustment coefficient is less than 1, the subarea backlight value outputting section configured to output the adjusted respective subarea backlight values to the driver circuits of the backlight sources in the corresponding backlight subareas to control the brightness of the backlight sources in the corresponding backlight subareas as a result of driving; and an image grayscale compensating section configured to determine a subarea image data block with the adjusted subarea backlight value below the first threshold, and to compensate for the grayscale value of each image pixel in the subarea image data block using a preset grayscale compensation coefficient larger than 1.

2. The apparatus according to claim 1, wherein the subarea backlight value gain section is further configured:

to obtain an average grayscale value of a global image according to grayscales of the global image; and to determine the backlight value gain coefficient according to a correspondence relationship between the average grayscale value of the global image and the preset backlight value gain coefficient.

3. The apparatus according to claim 2, wherein the subarea backlight value gain section comprises:

a backlight value gain coefficient lookup table in which the correspondence relationship between the average grayscale value of the global image and the preset backlight value gain coefficient is preset.

4. The apparatus according to claim 3, wherein the backlight value gain coefficient lookup table records a gain curve of the average grayscale value of the image and the backlight value gain coefficient, and the gain curve comprises a low brightness enhancement interval, a high brightness enhancement interval, and a power control interval as the average grayscale value of the image is increasing, and the gain coefficient in the high brightness enhancement interval is more than the gain coefficient in the low brightness enhancement interval and the gain coefficient in the power control interval.

5. The apparatus according to claim 1, wherein the subarea backlight value adjusting section is configured:

to search a preset backlight value adjustment coefficient lookup table for the subarea backlight value adjustment coefficient using the gained subarea backlight values, wherein a correspondence relationship between the backlight value and the adjustment coefficient is recorded in the adjustment coefficient lookup table.

6. The apparatus according to claim 5, wherein a curve of the correspondence relationship between the backlight value and the adjustment coefficient is an "S"-like curve, and the traversal axis of the "S"-like curve represents an input backlight value, and the vertical axis thereof represents an output backlight value.

7. The apparatus according to claim 1, wherein the image grayscale compensating section is configured:

to search a preset grayscale compensation coefficient lookup table for the compensation coefficient using the image grayscale value of the subarea image data block, wherein a correspondence relationship between the grayscale value and the compensation coefficient is recorded in the grayscale compensation coefficient lookup table.

8. The apparatus according to claim 7, wherein a compensation curve of the correspondence relationship between the grayscale value and the compensation coefficient is an inverted "S"-like curve, and the traversal axis of the inverted "S"-like curve represents an input grayscale value, and the vertical axis thereof represents an output grayscale value.

9. A liquid crystal display device, comprising:

a memory configured to store programs and various preset lookup table data;

an apparatus for controlling liquid crystal display brightness configured to execute the programs in the memory, and to invoke the various lookup table data according to the executed programs; to receive an image signal, to process the data, and to output the image data to a timing controller so that the timing controller generates a driver signal according to the image data to control a liquid crystal panel to display the image; and to output subarea backlight values to a backlight processing unit according to the image signal;

the backlight processing unit configured to determine duty ratios of corresponding PWM signals according to the respective subarea backlight values, and to output the duty ratios to a PWM driver unit; and the PWM driver unit configured to generate PWM control signals to control backlight sources in corresponding subareas;

wherein the apparatus for controlling liquid crystal display brightness comprises:

a subarea image grayscale determining section configured to determine image grayscale values of subarea image data blocks corresponding to backlight subareas according to a received image signal;

a subarea backlight value pre-obtaining section configured to pre-obtain subarea backlight values corresponding to the subarea image data blocks according to the image grayscale values of the subarea image data blocks;

a subarea backlight value gain section configured to multiply the pre-obtained subarea backlight values with a preset backlight value gain coefficient to obtain gained backlight values of the backlight subareas, wherein the preset backlight value gain coefficient is more than 1;

a subarea backlight value outputting section configured to output the respective gained subarea backlight values to driver circuits of backlight sources in the corresponding backlight subareas to control the brightness of the backlight sources in the corresponding backlight subareas as a result of driving;

a subarea backlight value adjusting section configured to determine a subarea backlight value adjustment coefficient, and to further multiply the gained subarea backlight values with the corresponding backlight value adjustment coefficient to obtain adjusted subarea backlight values, wherein if the pre-obtained subarea backlight values or the gained subarea backlight values are below a first threshold, then the backlight value adjustment coefficient is less than 1, the subarea backlight value outputting section configured to output the adjusted respective subarea backlight values to the driver circuits of the backlight sources in the corresponding backlight subareas to control the brightness of the backlight sources in the corresponding backlight subareas as a result of driving; and an image grayscale compensating section configured to determine a subarea image data block with the adjusted subarea backlight value below the first threshold, and to compensate for the grayscale value of each image pixel in the subarea image data block using a preset grayscale compensation coefficient larger than 1.

10. A method for controlling liquid crystal display brightness, the method comprising:

determining, by an apparatus for controlling liquid crystal display brightness, image grayscale values of subarea image data blocks corresponding to backlight subareas according to a received image signal, and pre-obtaining subarea backlight values corresponding to the subarea image data blocks according to the image grayscale values of the subarea image data blocks;

multiplying, by the apparatus for controlling liquid crystal display brightness, the pre-obtained subarea backlight values with a preset backlight value gain coefficient to obtain gained backlight values of the backlight subareas, wherein the preset backlight value gain coefficient is more than 1;

outputting, by the apparatus for controlling liquid crystal display brightness, the respective gained subarea backlight values to driver circuits of backlight sources in the corresponding backlight subareas to control the brightness of the backlight sources in the corresponding backlight subareas as a result of driving;

determining, by the apparatus for controlling liquid crystal display brightness, a subarea backlight value adjustment coefficient according to the gained subarea backlight values, and further multiplying the gained subarea backlight values with the corresponding backlight value adjustment coefficient to obtain adjusted subarea backlight values, wherein if the pre-obtained subarea backlight values or the gained subarea backlight values are below a first threshold, then the backlight value adjustment coefficient is less than 1;

outputting, by the apparatus for controlling liquid crystal display brightness, the adjusted respective subarea backlight values to the driver circuits of the backlight sources in the corresponding backlight subareas to control the brightness of the backlight sources in the corresponding backlight subareas as a result of driving; and determining, by the apparatus for controlling liquid crystal display brightness, a subarea image data block with the adjusted subarea backlight value below the first threshold, and compensating for the grayscale value of each image pixel in the subarea image data block using a preset grayscale compensation coefficient larger than 1.

11. The method according to claim 10, wherein the preset backlight value gain coefficient is obtained by:

obtaining an average grayscale value of a global image according to grayscales of the global image; and determining the backlight value gain coefficient according to a correspondence relationship between the average grayscale value of the global image and the preset backlight value gain coefficient.

12. The method according to claim 11, wherein the correspondence relationship between the average grayscale value of the global image and the preset backlight value gain coefficient satisfies a gain curve comprising a low brightness enhancement interval, a high brightness enhancement interval, and a power control interval as the average grayscale value of the image is increasing, wherein the gain coefficient in the high brightness enhancement interval is more than the gain coefficient in the low brightness enhancement interval and the gain coefficient in the power control interval.

13. The method according to claim 10, wherein the backlight value adjustment coefficient is obtained by:

searching a preset backlight value adjustment coefficient lookup table for the subarea backlight value adjustment coefficient using the gained subarea backlight values, wherein a correspondence relationship between the backlight value and the adjustment coefficient is recorded in the adjustment coefficient lookup table.

14. The method according to claim 13, wherein a curve of the correspondence relationship between the backlight value and the adjustment coefficient is an "S"-like curve, and the traversal axis of the "S"-like curve represents an input backlight value, and the vertical axis thereof represents an output backlight value.

15. The method according to claim 10, wherein the compensation coefficient is obtained by:

searching a preset grayscale compensation coefficient lookup table for the compensation coefficient using the image grayscale value of the subarea image data block, wherein a correspondence relationship between the grayscale value and the compensation coefficient is recorded in the grayscale compensation coefficient lookup table.

16. The method according to claim 15, wherein a compensation curve of the correspondence relationship between the grayscale value and the compensation coefficient is an inverted "S"-like curve, and the traversal axis of the inverted "S"-like curve represents an input grayscale value, and the vertical axis thereof represents an output grayscale value.

* * * * *